US007644490B1

(12) United States Patent
Niblock et al.

(10) Patent No.: US 7,644,490 B1
(45) Date of Patent: Jan. 12, 2010

(54) METHOD OF FORMING A MICROELECTROMECHANICAL (MEMS) DEVICE

(75) Inventors: Trevor Niblock, Santa Clara, CA (US); Peter Johnson, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 3 days.

(21) Appl. No.: 11/805,933

(22) Filed: May 25, 2007

(51) Int. Cl.
*H01H 11/00* (2006.01)
*H01H 11/02* (2006.01)
*H01H 11/04* (2006.01)
*H01H 65/00* (2006.01)

(52) U.S. Cl. ..... 29/622; 29/611; 29/825; 29/830; 29/843; 29/846; 216/33; 216/36; 216/80; 257/684; 257/218; 257/415; 257/419; 257/619; 361/277; 361/278; 361/280; 361/281; 438/52; 438/53; 438/71; 438/121

(58) Field of Classification Search ..... 29/611, 29/622, 825, 830, 843, 846, 874; 216/33, 216/36, 80; 257/E21.218, 415, 419, 619, 257/684; 361/277, 278, 280, 281; 438/52, 438/53, 71, 121
See application file for complete search history.

(56) References Cited

U.S. PATENT DOCUMENTS

| | | | | |
|---|---|---|---|---|
| 5,578,976 | A | 11/1996 | Yao | |
| 5,880,921 | A * | 3/1999 | Tham et al. | 361/233 |
| 6,016,092 | A | 1/2000 | Qiu et al. | |
| 6,094,116 | A | 7/2000 | Tai et al. | |
| 6,169,826 | B1 | 1/2001 | Nishiyama et al. | 385/22 |
| 6,360,036 | B1 | 3/2002 | Couillard | 385/19 |
| 6,469,602 | B2 * | 10/2002 | Ruan et al. | 335/78 |
| 6,573,822 | B2 * | 6/2003 | Ma et al. | 336/223 |
| 6,842,558 | B2 | 1/2005 | Mitsuoka et al. | |
| 7,095,919 | B2 | 8/2006 | Kawamoto et al. | 385/18 |
| 7,202,763 | B2 | 4/2007 | Six | |
| 7,327,211 | B2 | 2/2008 | Ruan et al. | |
| 7,381,663 | B2 * | 6/2008 | Sato et al. | 257/415 |
| 7,444,042 | B1 | 10/2008 | Niblock et al. | |
| 7,464,459 | B1 | 12/2008 | Niblock et al. | |
| 2003/0030998 | A1 | 2/2003 | Mhani et al. | |
| 2004/0001667 | A1 | 1/2004 | Childers | |
| 2004/0022484 | A1 | 2/2004 | Sigloch et al. | 385/22 |

OTHER PUBLICATIONS

Gary D. Gray Jr., et al. "Magnetically Bistable Actuator Part 2. Fabrication and Performance", Sensors and Actuators A: Physical, vol. 119, Issue 2, Apr. 13, 2005, pp. 502-511.

(Continued)

*Primary Examiner*—Paul D Kim
(74) *Attorney, Agent, or Firm*—Mark C. Pickering

(57) ABSTRACT

A method of forming an actuator and a relay using a micro-electromechanical (MEMS)-based process is disclosed. The method first forms the lower sections of a square copper coil, and then forms an actuation member that includes a core section and a horizontally adjacent floating cantilever section. The core section, which lies directly over the lower coil sections, is electrically isolated from the lower coil sections. The method next forms the side and upper sections of the coil, along with first and second electrodes that are separated by a switch gap. The first electrode lies directly over an end of the core section, while the second electrode lies directly over an end of the floating cantilever section.

24 Claims, 32 Drawing Sheets

OTHER PUBLICATIONS

Gary D. Gray Jr. And Paul A. Kohl, "Magnetically Bistable Actuator Part 1. Ultra-Low Switching Energy And Modeling", Sensors and Actuators A: Physical, vol. 119, Issue 2, Apr. 13, 2005, pp. 489-501.

John A. Wright, et al., "Micro-Miniature Electromagnetic Switches Fabricated Using MEMS Technology", Proceedings: 46th Annual International Relay Conference: NARM '98, Oak Brook, Illinois, Apr. 1998, pp. 13-1 to 13-4.

Han S. Lee, et al., "Micro-Electro-Mechanical Relays—Design Concepts and Process Demonstrations", Joint 22nd International Conference on Electrical Contacts and 50th IEEE HOLM Conference on Electrical Contacts, Sep. 20-23, 2004, pp. 242-247.

J.H. Fabian, et al., "Maxtrix Combination of MEMS Relays", 17th IEEE International Conference on Micro Electro Mechanical Systems, 2004, pp. 861-864.

Ernst Thielicke and Ernst Obermeier, "A Fast Switching Surface Micromachined Electrostatic Relay", The 12th International Conference on Solid State Sensors, Actuators and Microsystems, Boston, Jun. 8-12, 2003, pp. 899-902.

Ren Wanbin, et al., "Finite Element Analysis of Magnetic Structures for Micro-Electro-Mechanical Relays", Proceedings of the 51st IEEE HOLM Conference on Electrical Contacts, Sep. 26-28, 2005, pp. 265-269.

John A. Wright, et al., "Magnetostatic MEMS Relays For The Miniaturization Of Brushless DC Motor Controllers", 12th IEEE International Conference on Micro Electro Mechanical Systems, Jan. 17-21, 1999, pp. 594-599.

U.S. Appl. No. 11/805,934, filed May 25, 2007, Niblock et al.

U.S. Appl. No. 11/805,955, filed May 25, 2007, Niblock et al.

U.S. Appl. No. 11/807,161, filed May 25, 2007, Niblock et al.

U.S. Appl. No. 11/807,162, filed May 25, 2007, Niblock et al.

U.S. Appl. No. 11/807,162, filed May 25, 2007, to Niblock et al. See attached IDS Letter for relevance.

U.S. Appl. No. 11/805,934, filed May 25, 2007, to Niblock et al. See attached IDS Letter for relevance.

U.S. Appl. No. 11/807,161, filed May 25, 2007, to Niblock et al. See attached IDS Letter for relevance.

U.S. Appl. No. 11/805,955, filed May 25, 2007, to Niblock et al. See attached IDS Letter for relevance.

U.S. Appl. No. 12/283,969, filed Sep. 17, 2008, to Niblock et al. See attached IDS Letter for relevance.

U.S. Appl. No. 11/807,162, filed on May 25, 2007 to Niblock et al. See attached IDS Letter for relevance.

U.S. Appl. No. 11/805,934, filed on May 25, 2007 to Niblock et al. See attached IDS Letter for relevance.

U.S. Appl.n No. 12/283,969, filed on Sep. 17, 2008 to Niblock et al. See attached IDS Letter for relevance.

John A. Wright, et al., "Micro-Miniature Electromagnetic Switches Fabricated Using MEMS Technology," Proceedings: 46th Annual International Relay Conference:NARM '98, Oak Brook, Illinois, Apr. 1998, pp. 13-1 to 13-4. See attached IDS Letter for relevance.

* cited by examiner

METHOD OF FORMING A MICROELECTROMECHANICAL (MEMS) DEVICE

BACKGROUND OF THE INVENTION

1. Field of the Invention

The present invention relates to actuators and relays and, more particularly, to a method of forming a MEMS actuator and relay with horizontal actuation.

2. Description of the Related Art

A switch is a well-known device that connects, disconnects, or changes connections between devices. An electrical switch is a switch that provides a low-impedance electrical pathway when the switch is "closed," and a high-impedance electrical pathway when the switch is "opened." A mechanical-electrical switch is a type of switch where the low-impedance electrical pathway is formed by physically bringing two electrical contacts together, and the high-impedance electrical pathway is formed by physically separating the two electrical contacts from each other.

An actuator is a well-known mechanical device that moves or controls a mechanical member to move or control another device. Actuators are commonly used with mechanical-electrical switches to move or control a mechanical member that closes and opens the switch, thereby providing the low-impedance and high-impedance electrical pathways, respectively, in response to the actuator.

A relay is a combination of a switch and an actuator where the mechanical member in the actuator moves in response to electromagnetic changes in the conditions of an electrical circuit. For example, electromagnetic changes due to the presence or absence of a current in a coil can cause the mechanical member in the actuator to close and open the switch.

One approach to implementing actuators and relays is to use micro-electromechanical (MEMS) technology. MEMS devices are formed using the same fabrication processes that are used to form conventional semiconductor devices, such as bipolar and CMOS transistors. Although a number of approaches exist for forming MEMS actuators and relays, there is a need for an additional approach to forming MEMS actuators and relays.

BRIEF DESCRIPTION OF THE DRAWINGS

FIGS. 1A-11A are plan views illustrating a method of forming a MEMS-based actuator 100 in accordance with the present invention.

FIGS. 1B-11B are cross-sectional views taken along lines 1B-1B of FIGS. 1A through 11B-11B of FIG. 11A, respectively.

FIGS. 1C-11C are cross-sectional views taken along lines 1C-1C of FIG. 1A through 11C-11C of FIG. 11A, respectively.

FIGS. 1D-11D are cross-sectional views taken along lines 1D-1D of FIGS. 1A through 11D-11D of FIG. 11A, respectively.

FIGS. 1E-11E are cross-sectional views taken along lines 1E-1E of FIGS. 1A through 11E-11E of FIG. 11A, respectively.

FIGS. 12A-20A are plan views illustrating a method of forming a MEMS-based relay 1200 in accordance with the present invention.

FIGS. 12B-20B are cross-sectional views taken along lines 12B-12B of FIGS. 12A through 20B-20B of FIG. 20A, respectively.

FIGS. 12C-20C are cross-sectional views taken along lines 12C-12C of FIGS. 12A through 20C-20C of FIG. 20A, respectively.

FIGS. 12D-20D are cross-sectional views taken along lines 12D-12D of FIGS. 12A through 20D-20D of FIG. 20A, respectively.

FIGS. 12E-20E are cross-sectional views taken along lines 12E-12E of FIGS. 12A through 20E-20E of FIG. 20A, respectively.

FIGS. 12F-20F are cross-sectional views taken along lines 12F-12F of FIGS. 12A through 20F-20F of FIG. 20A, respectively.

DETAILED DESCRIPTION OF THE INVENTION

Figure 1A:
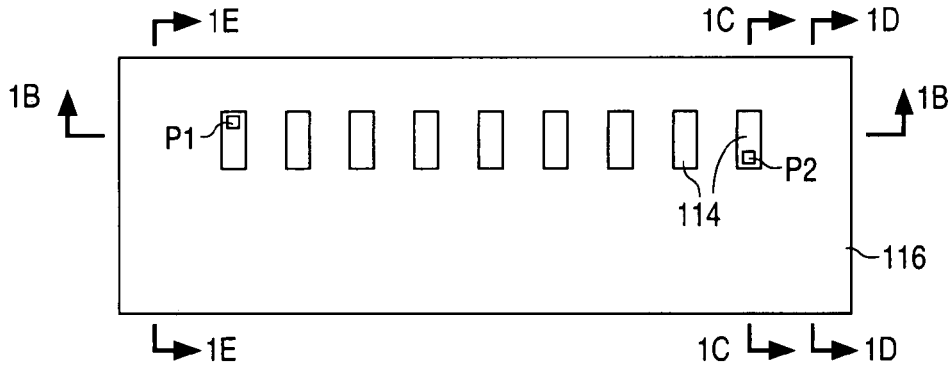
Figure 1B:
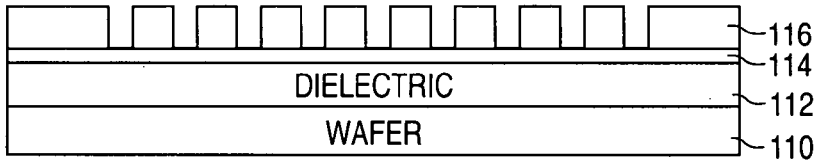
Figure 1C:
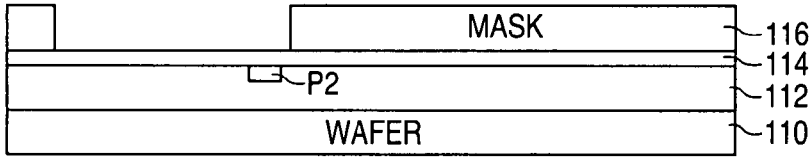
Figure 1D:
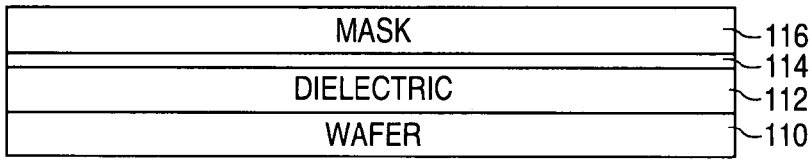
Figure 1E:
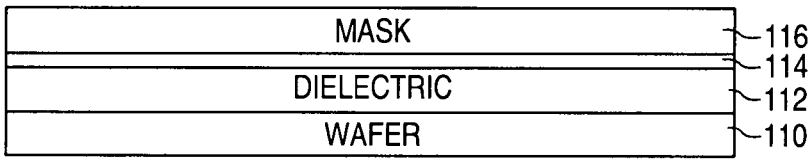
Figure 2A:
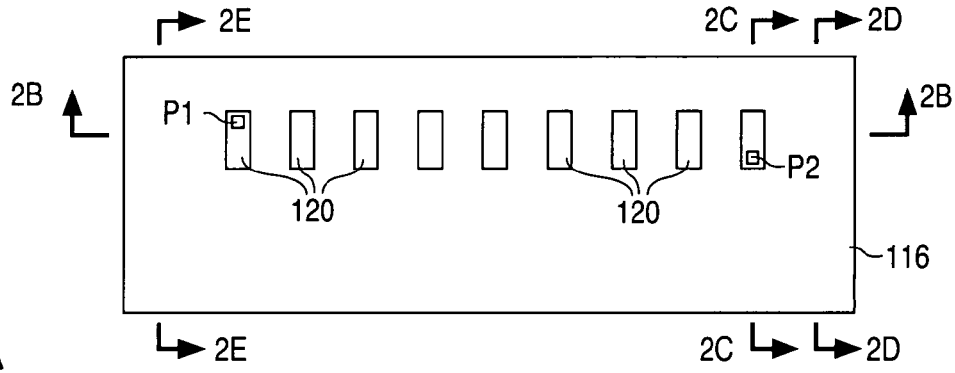
Figure 2B:
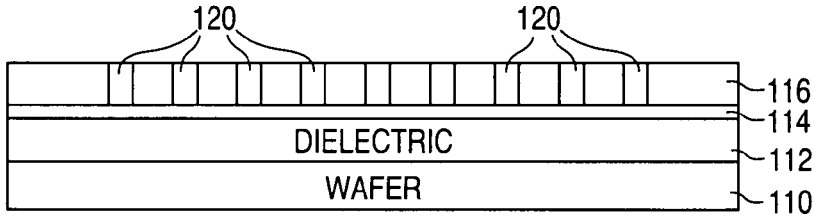
Figure 2C:
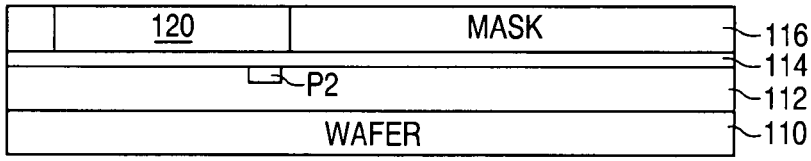
Figure 2D:
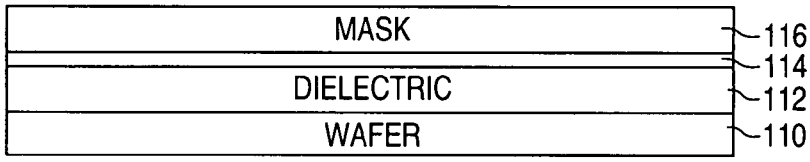
Figure 2E:
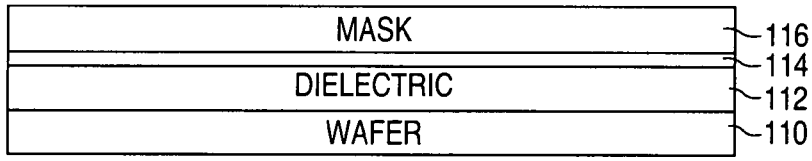
Figure 3A:
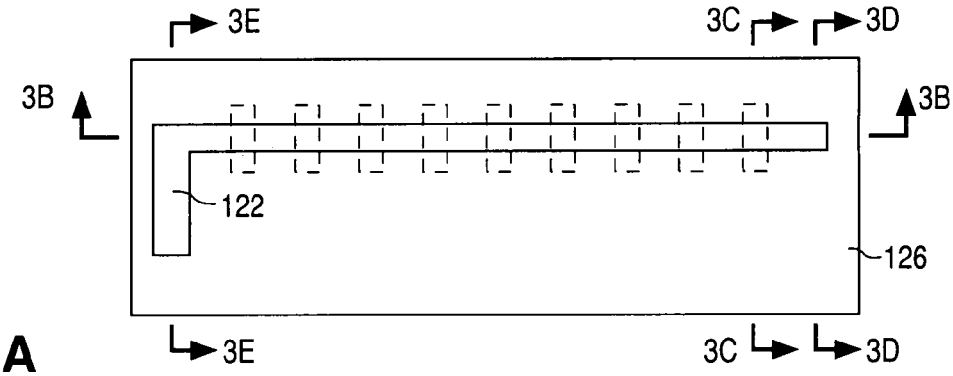
Figure 3B:
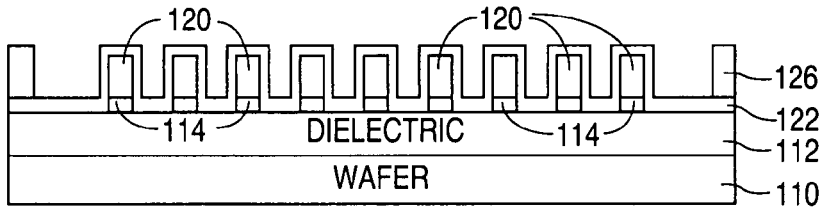
Figure 3C:
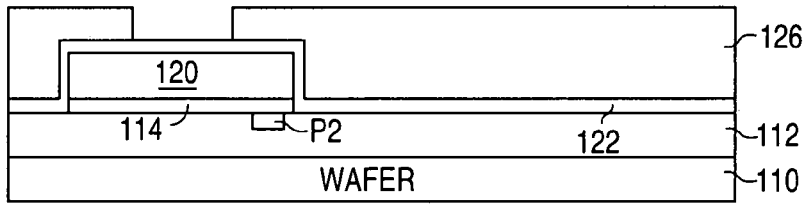
Figure 3D:
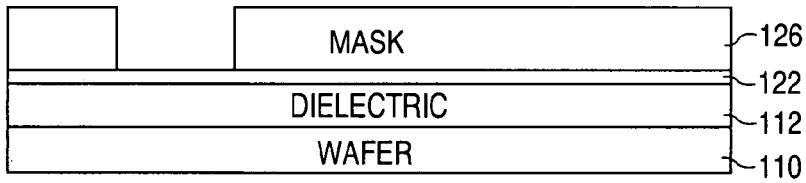
Figure 3E:
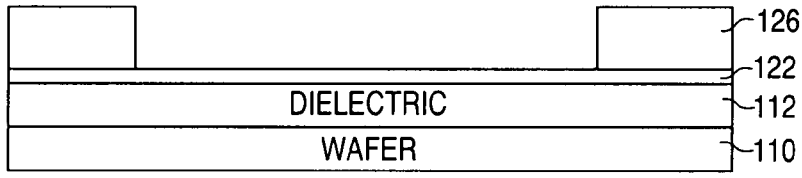
Figure 4A:
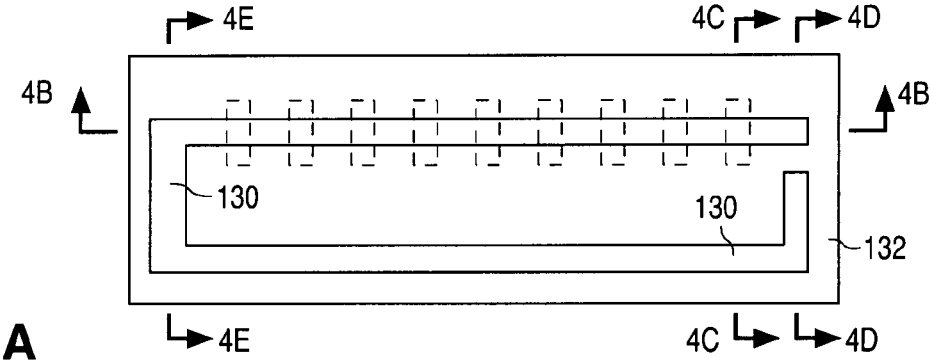
Figure 4B:
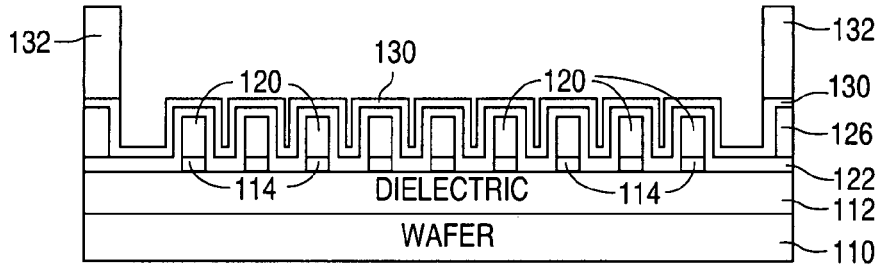
Figure 4C:
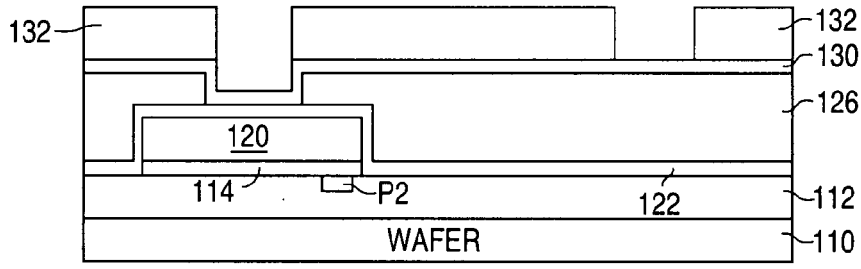
Figure 4D:
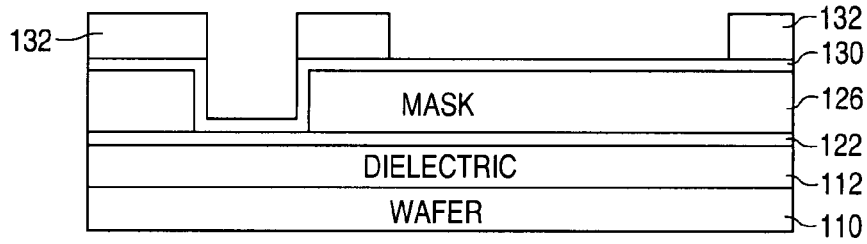
Figure 4E:
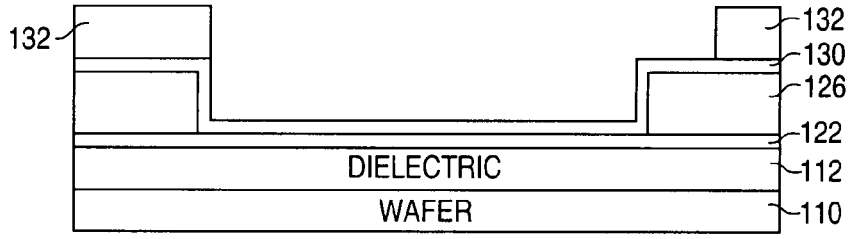
Figure 5A:
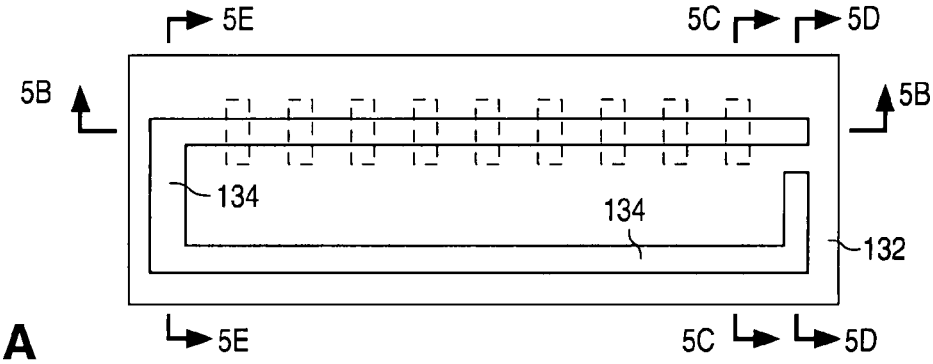
Figure 5B:
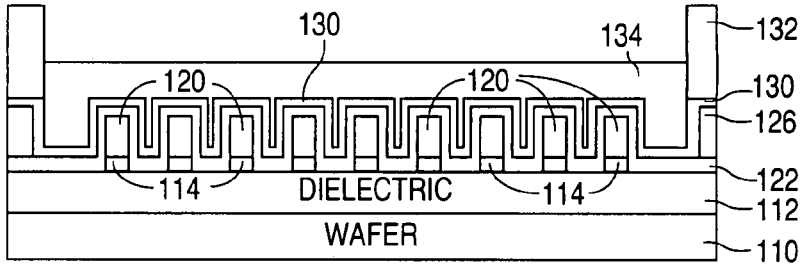
Figure 5C:
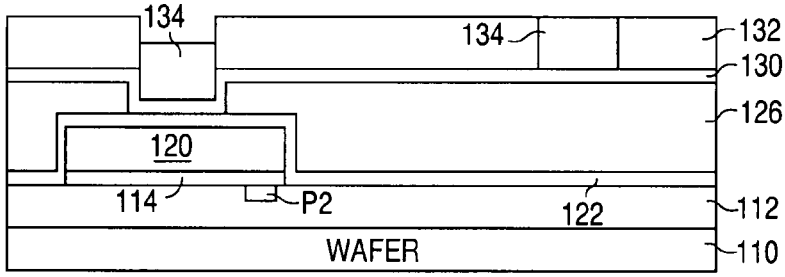
Figure 5D:
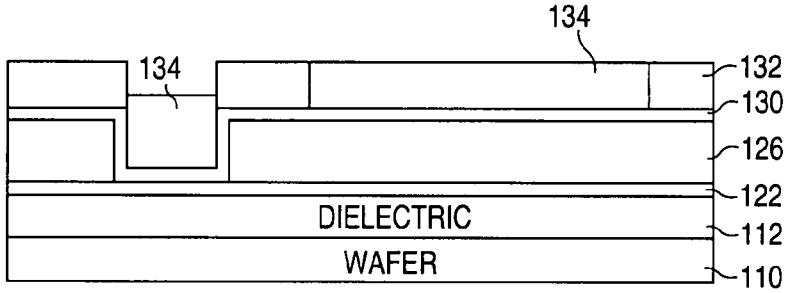
Figure 5E:
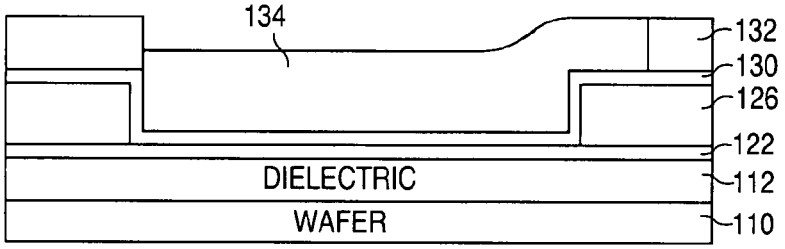
Figure 6A:
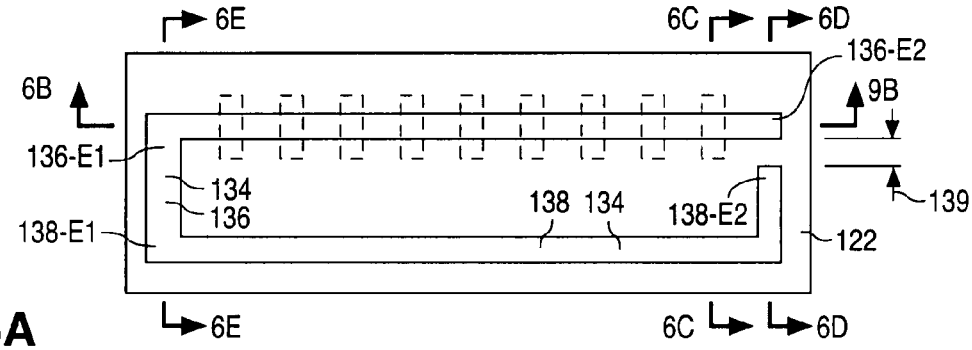
Figure 6B:
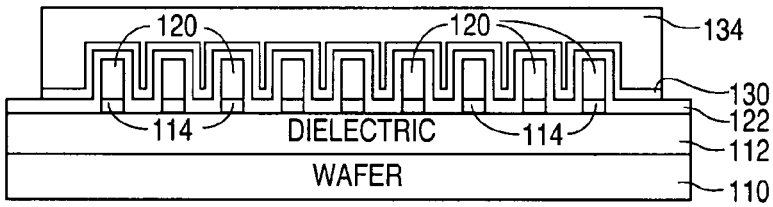
Figure 6C:
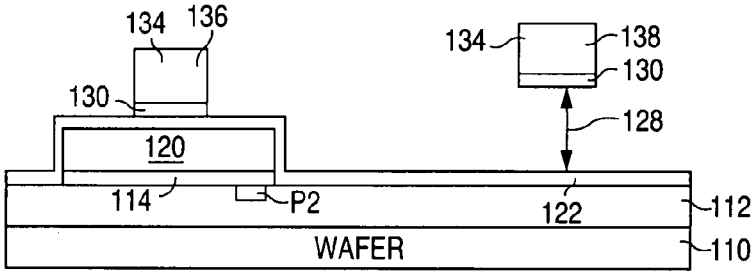
Figure 6D:
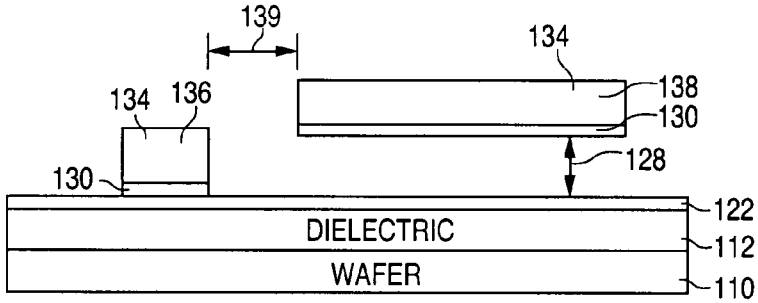
Figure 6E:
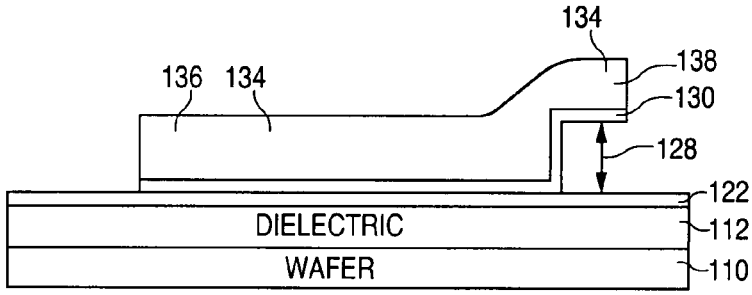
Figure 7A:
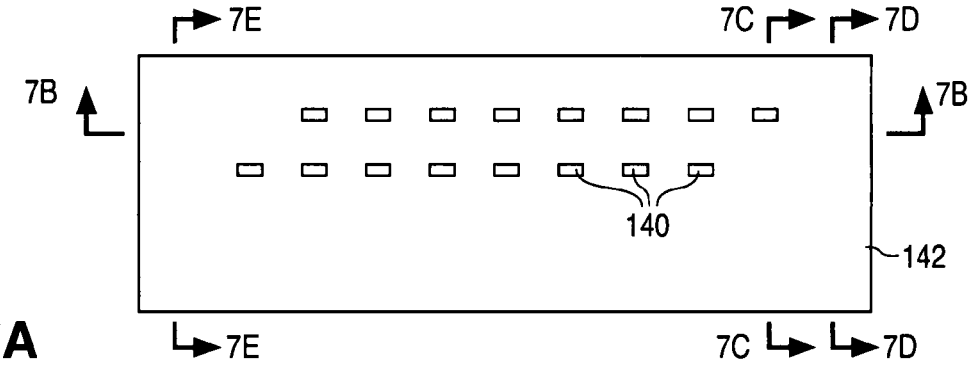
Figure 7B:
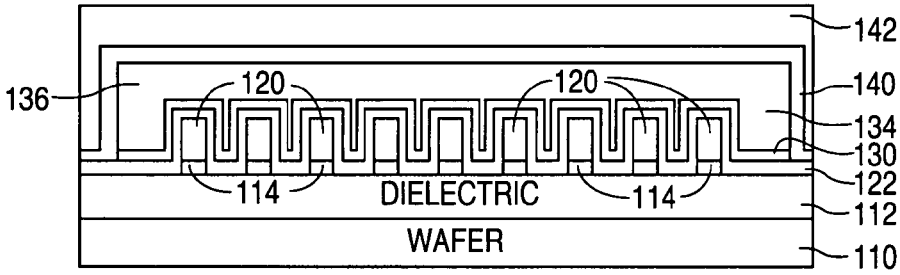
Figure 7C:
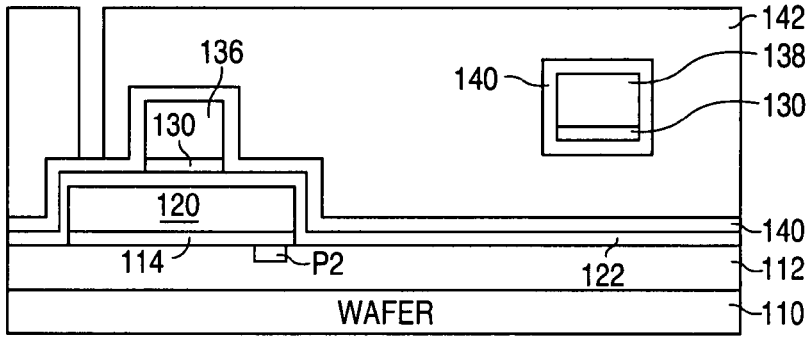
Figure 7D:
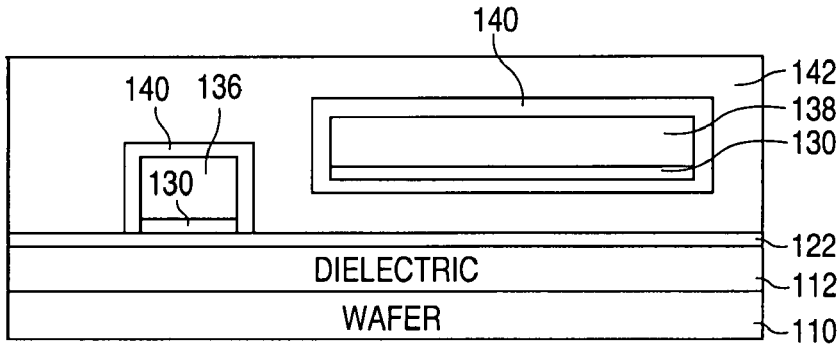
Figure 7E:
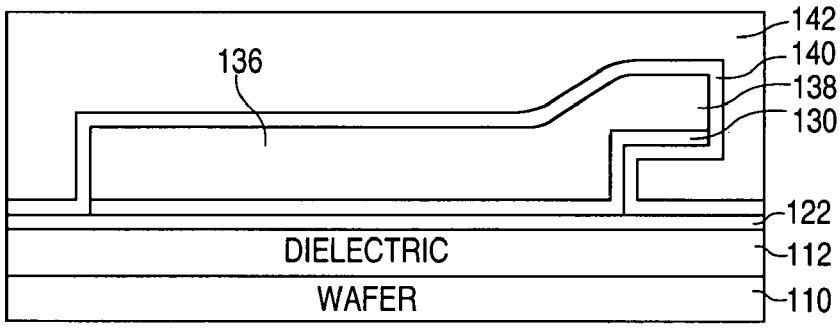
Figure 8A:
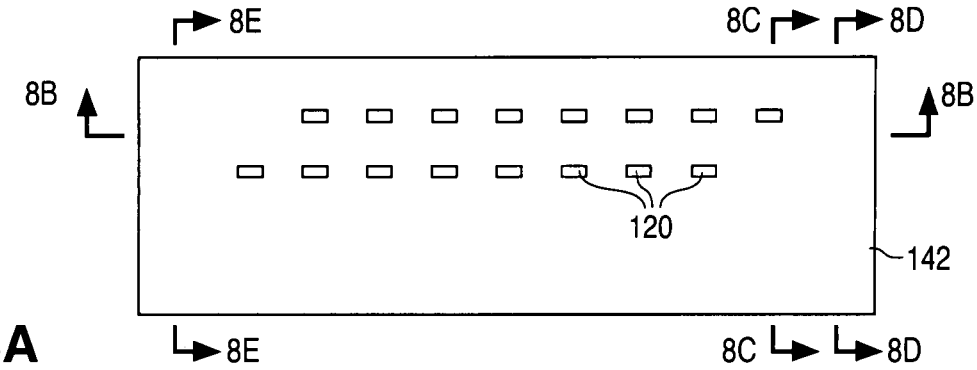
Figure 8B:
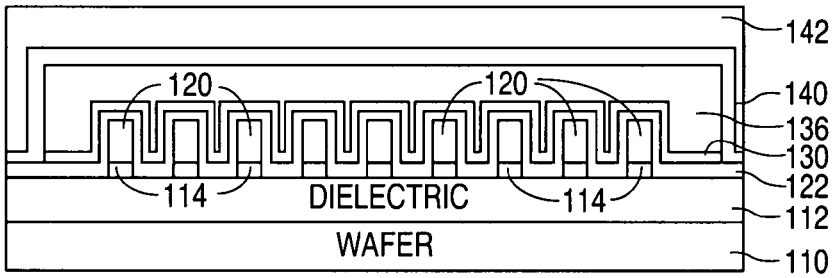
Figure 8C:
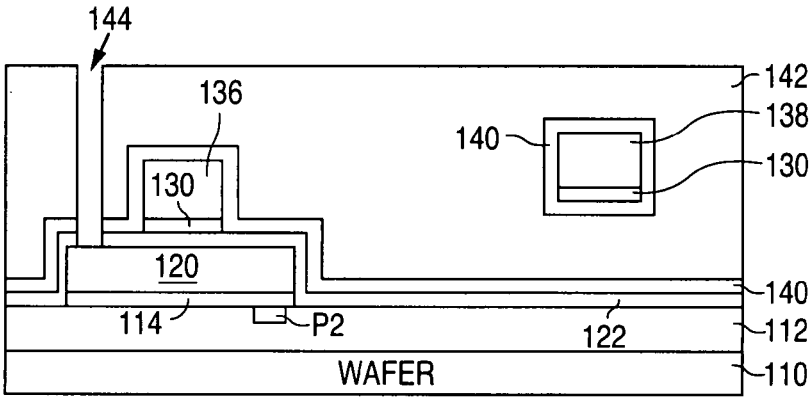
Figure 8D:
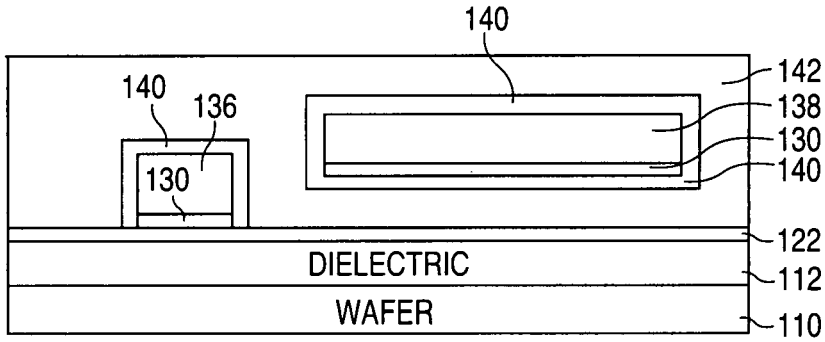
Figure 8E:
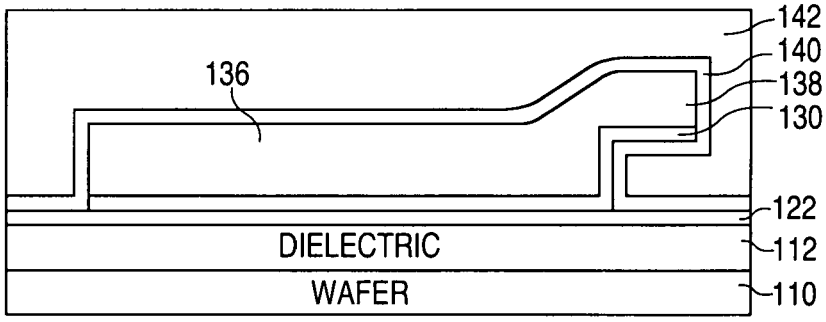
Figure 9A:
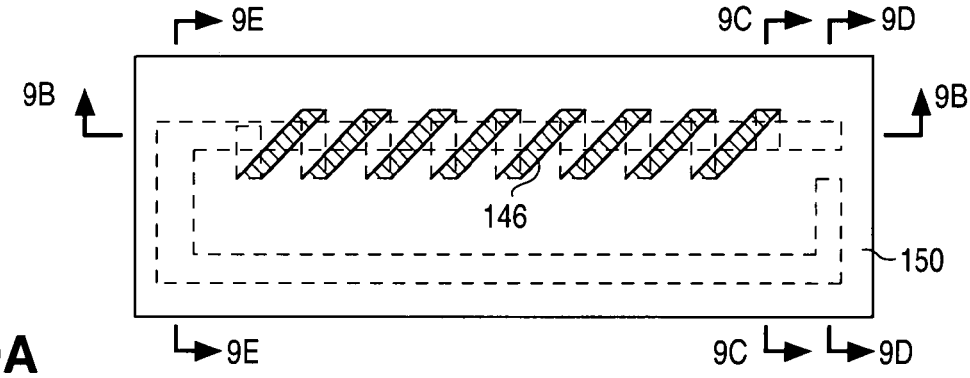
Figure 9B:
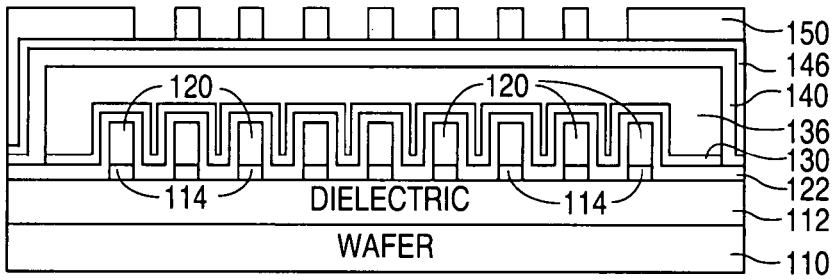
Figure 9C:
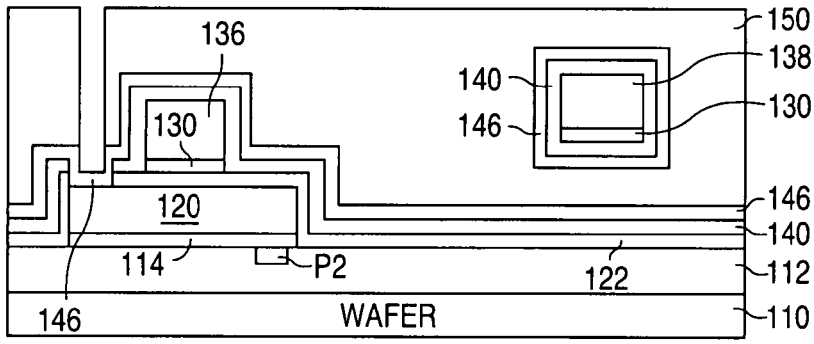
Figure 9D:
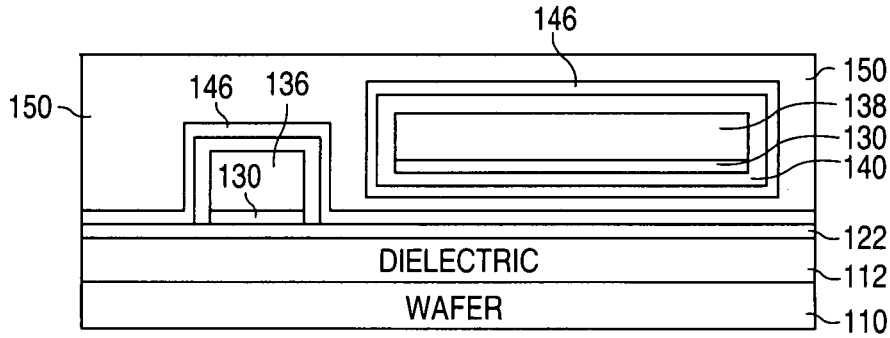
Figure 9E:
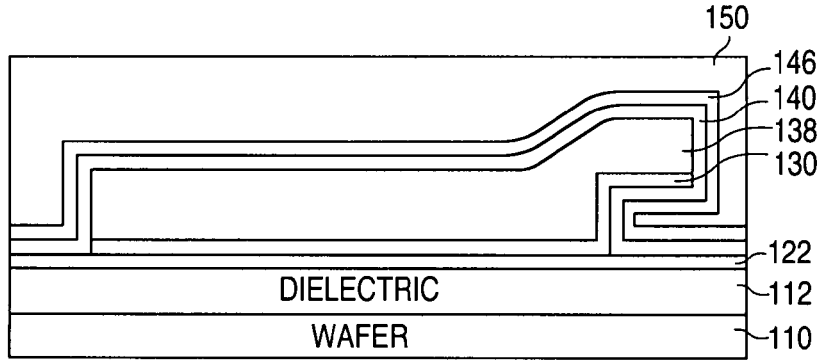
Figure 10A:
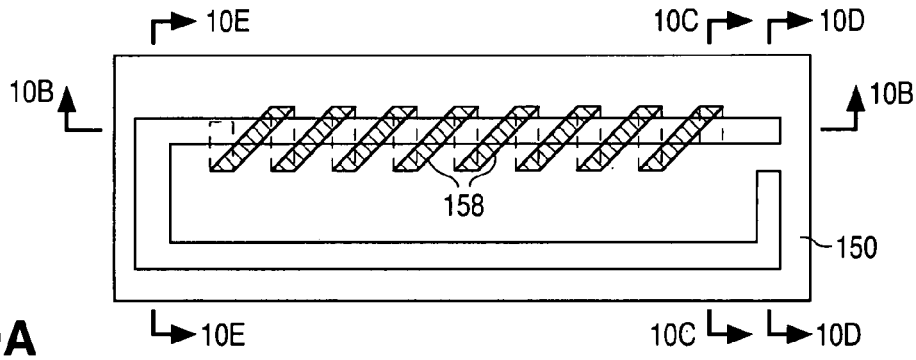
Figure 10B:
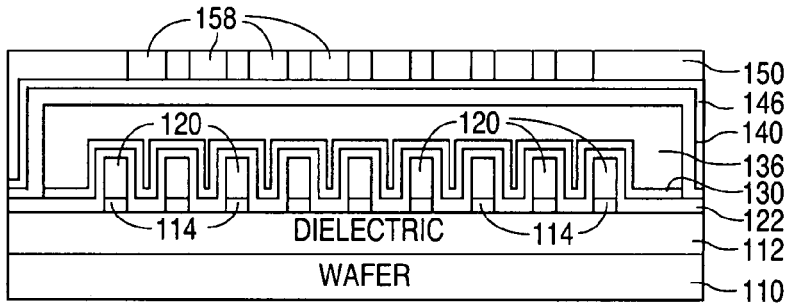
Figure 10C:
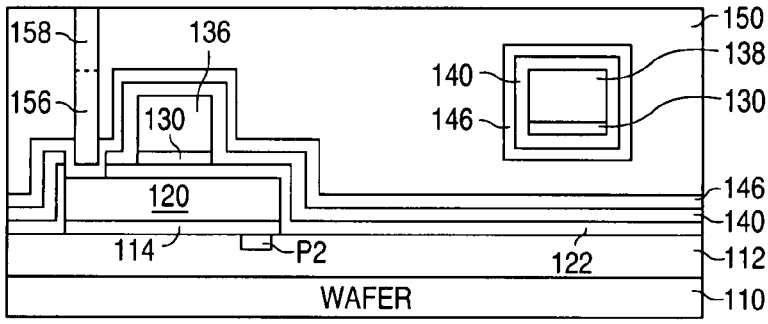
Figure 10D:
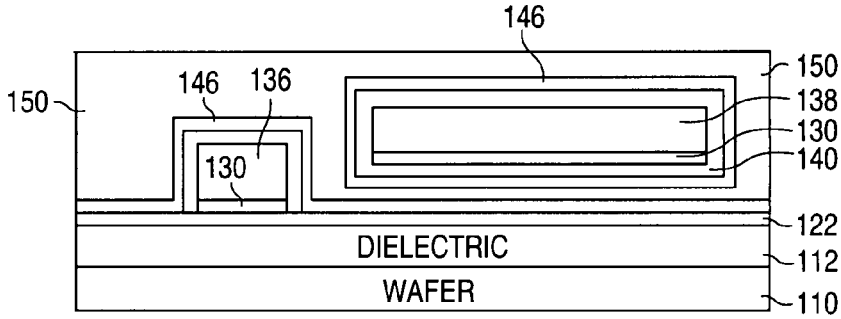
Figure 10E:
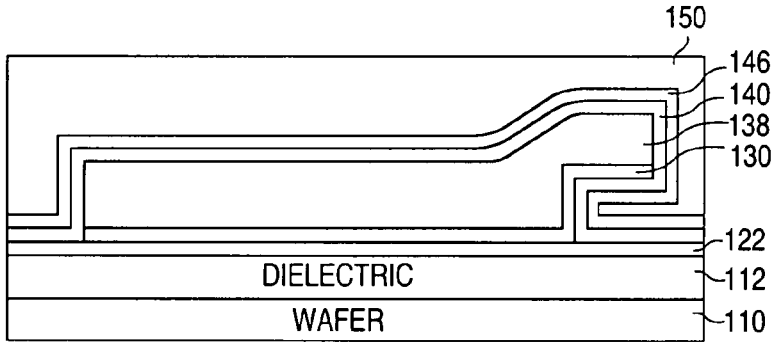

FIGS. 1A-11A, 1B-11B, 1C-11C, 1D-11D, and 1E-11E show a series of views that illustrate a method of forming a MEMS actuator 100 in accordance with the present invention. As shown in FIGS. 1A-1E, the method utilizes a conventionally formed single-crystal silicon semiconductor wafer 110 that has an overlying dielectric layer 112.

Dielectric layer 112 can represent a dielectric layer that includes no metal structures, or a dielectric layer that includes metal structures, such as the dielectric layer of a metal interconnect structure. When formed as the dielectric layer of a metal interconnect structure, dielectric layer 112 includes levels of metal traces, which are typically aluminum, a large number of contacts that connect the bottom metal trace to electrically conductive regions on wafer 110, and a large number of inter-metal vias that connect the metal traces in adjacent layers together. Further, selected regions on the top surfaces of the metal traces in the top metal layer function as pads which provide external connection points.

In the present example, dielectric layer 112 represents the dielectric layer of a metal interconnect structure that also includes pads P1 and P2. Pads P1 and P2 are selected regions on the top surfaces of two of the metal traces in the top layer of metal traces that provide electrical connections for a to-be-formed square coil. (Only pad P2, and not the entire metal interconnect structure, is shown in cross-section in FIGS. 1C-11C for clarity.)

Referring again to FIGS. 1A-1E, the method begins by forming a seed layer 114 on the top surface of dielectric layer 112. In the present example, since dielectric layer 112 represents the dielectric layer of a metal interconnect structure, seed layer 114 is also formed on the pads P1 and P2.

Seed layer 114 typically includes a layer of titanium (e.g., 300 Å thick) and an overlying layer of copper (e.g., 3000 Å thick). The titanium layer enhances the adhesion between the aluminum in the underlying metal traces and the overlying layer of copper. Once seed layer 114 has been formed, a mask 116, such as a layer of photoresist, is formed and patterned on the top surface of seed layer 114.

As shown in FIGS. 2A-2E, following the formation and patterning of mask 116, copper is deposited by electroplating to form a number of spaced-apart copper lower sections 120. The copper lower sections 120 form the lower sides of the to-be-formed square coil. Since dielectric layer 112 represents the dielectric layer of a metal interconnect structure in the present example, the ends of the copper lower sections 120 that correspond with the opposite ends of the square coil are electrically connected to pads P1 and P2. After the copper lower sections 120 have been formed, mask 116 is removed, followed by the removal of the underlying regions of seed layer 114.

Next, as shown in FIGS. 3A-3E, a dielectric layer 122, such as an oxide layer, is conformally deposited on dielectric layer 112 and the copper lower sections 120. Once dielectric layer 122 has been formed, a mask 126, such as a layer of photoresist, is then formed and patterned on the top surface of dielectric layer 122.

As shown in FIGS. 4A-4E, after the formation and patterning of mask 126, a seed layer 130 is formed on the top surface of dielectric layer 122 and mask 126. After seed layer 130 has been formed, a mask 132, such as a layer of photoresist, is formed and patterned on the top surface of seed layer 130.

Following the formation and patterning of mask 132, as shown in FIGS. 5A-5E, a magnetic material, such as an alloy of nickel and iron like permalloy, is deposited by electroplating to form an actuation member 134. Once actuation member 134 has been formed, as shown in FIGS. 6A-6E, mask 132, the underlying regions of seed layer 130, and mask 126 are removed.

The removal of these materials leaves actuation member 134 with a core section 136 and a floating cantilever section 138. Core section 136, which is defined by the opening in mask 126 and the overlying portion of mask 132, touches dielectric layer 122. Further, core section 136 has a first end 136-E1 and a spaced apart second end 136-E2.

Floating cantilever section 138, in turn, is defined by the opening in mask 132 that lies over mask 126. Thus, floating cantilever section 138 is vertically spaced apart from dielectric layer 122 by underlying mask 126, and thereby floats after underlying mask 126 has been removed. As a result, the thickness of mask 126 determines an offset gap 128, which is the vertical spacing that lies between dielectric layer 122 and floating cantilever section 138. Further, floating cantilever section 138 has a first end 138-E1 and a spaced apart second end 138-E2.

In addition, as further shown in FIGS. 6A-6E, the second end 136-E2 of core section 136 and the second end 138-E2 of floating cantilever section 138 are horizontally spaced apart by an actuation gap 139. The size of actuation gap 139 is defined by the patterns in masks 126 and 132. Thus, as a result of offset gap 128 and the actuation gap 139, floating cantilever section 138 is horizontally movable so that the second end 138-E2 can move towards the second end 136-E2 of core section 136 to touch the second end 136-E2 of core section 136.

Next, as shown in FIGS. 7A-7E, a dielectric layer 140, such as an oxide layer, is conformally deposited on dielectric layer 122 and actuation member 134. After dielectric layer 140 has been formed, a mask 142, such as a layer of photoresist, is then formed and patterned on the top surface of dielectric layer 140.

Following the formation and patterning of mask 142, as shown in FIGS. 8A-8E, the exposed regions of the dielectric layer 140 and underlying dielectric layer 122 are etched to form vertical openings 144 that expose the top surfaces of the ends of the copper lower sections 120 that form the lower sides of the to-be-formed square coil. Mask 142 is then removed.

Once mask 142 has been removed, as shown in FIGS. 9A-9E, a seed layer 146 is formed on the exposed ends of the copper lower sections 120 and the top surface of dielectric layer 140. After seed layer 146 has been formed, a mask 150, such as a layer of photoresist, is formed and patterned on the top surface of seed layer 146. The pattern in mask 150 is shown hatched in FIG. 9A.

Next, as shown in FIGS. 10A-10E, following the formation and patterning of mask 150, copper is deposited by electroplating to form a number of copper side sections 156 of the square coil, and a number of copper upper sections 158 of the square coil. The copper upper sections 158 of the square coil are shown hatched in FIG. 10A. Following this, as shown in FIGS. 11A-11E, mask 150 and the underlying regions of seed layer 146 are removed to complete the process.

Thus, a method of forming actuator 100 has been described. As shown in FIGS. 11A-11E, actuator 100 has a square coil 160 that lies on dielectric layer 112. In the present example, coil 160 is formed by connecting together the copper lower sections 120, the copper side sections 156, and the copper upper sections 158.

Actuator 100 also has actuation member 134 which, in turn, has core section 136 and floating cantilever section 138. Core section 136 lies within and is isolated from coil 160 by dielectric layer 122 and dielectric layer 140. In addition, core section 136 has first and second ends 136-E1 and 136-E2 that lie outside of the outer lower sections 120 of coil 160.

Floating cantilever section 138, which has first end 138-E1 and second end 138-E2, floats vertically above dielectric layer 122 by offset gap 128, while the second end 138-E2 of floating cantilever section 138 is horizontally spaced apart from the second end 136-E2 of core section 136 by actuation gap 139.

As a result, the second end 138-E2 of floating cantilever section 138 is horizontally movable towards the second end 136-E2 of core section 136. In addition, the first end 138-E1 of floating cantilever section 138 touches the first end 136-E1 of core section 136. Further, actuation member 134 is implemented with a magnetic material, such as an alloy of nickel and iron like permalloy.

Figure 11A:
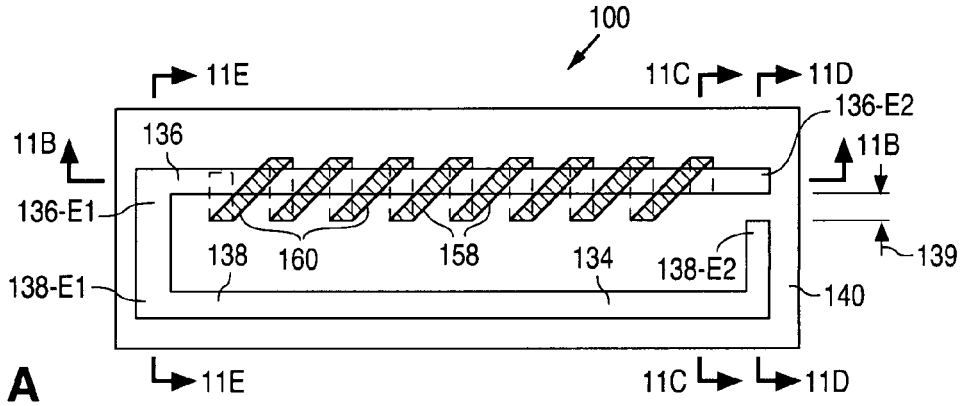
Figure 11B:
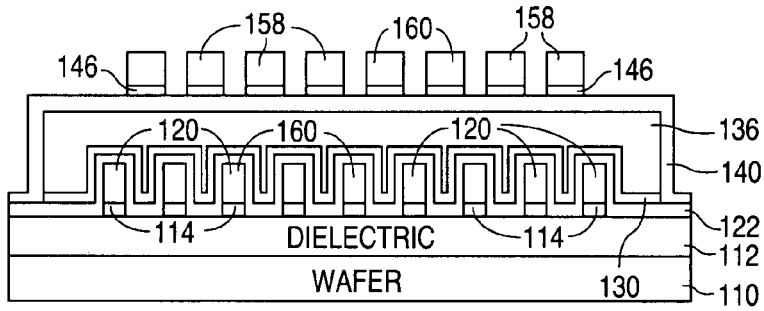
Figure 11C:
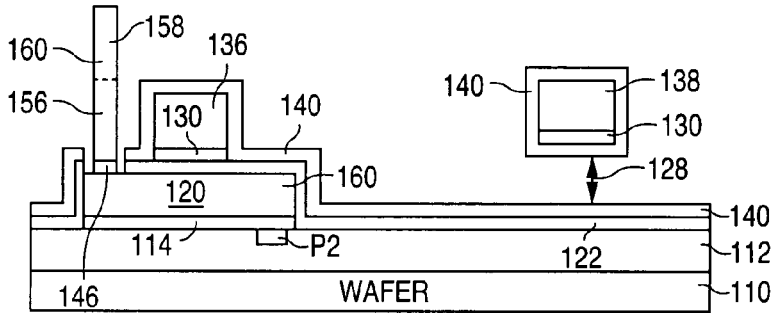
Figure 11D:
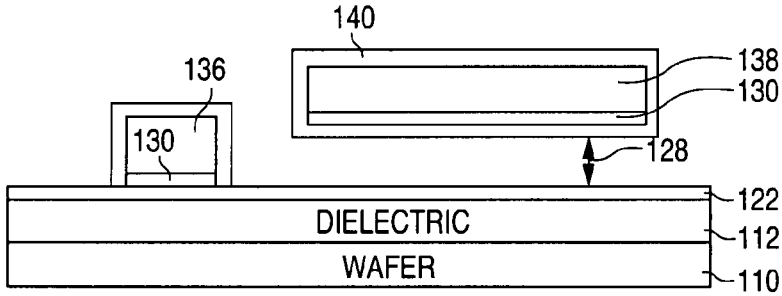
Figure 11E:
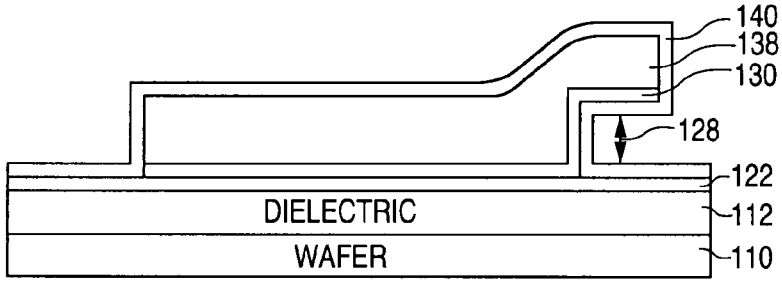
Figure 12A:
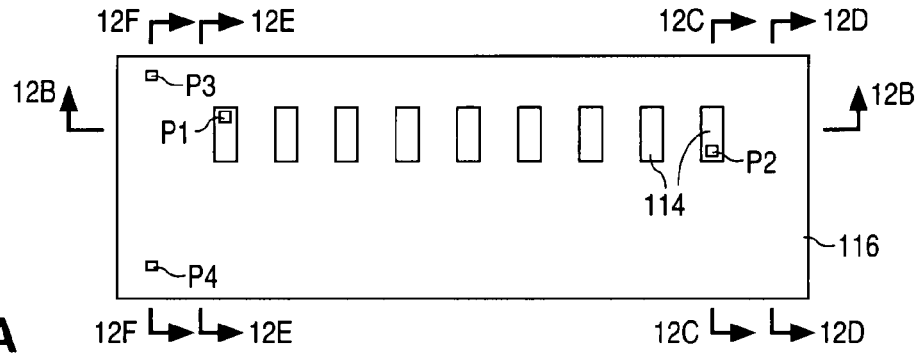
Figure 12B:
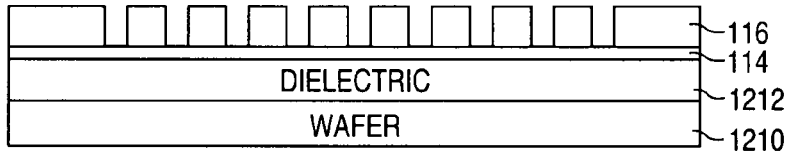
Figure 12C:
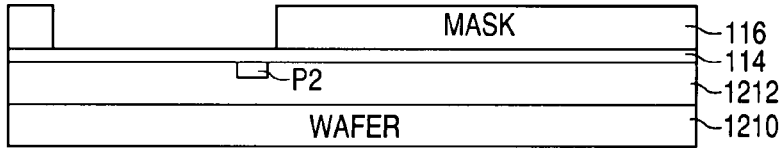
Figure 12D:
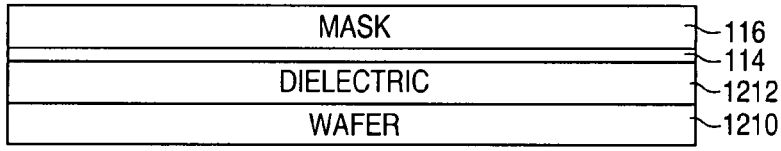
Figure 12E:
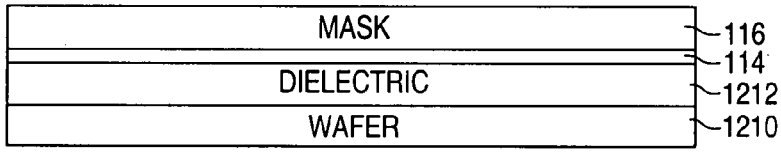
Figure 12F:
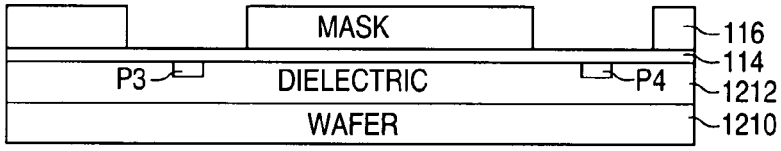
Figure 13A:
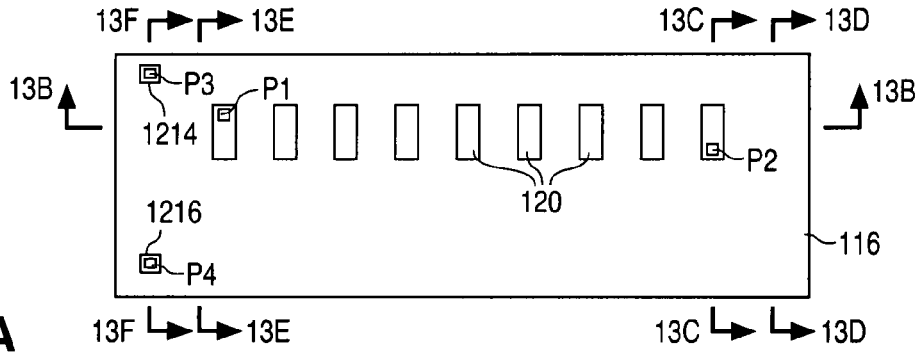
Figure 13B:
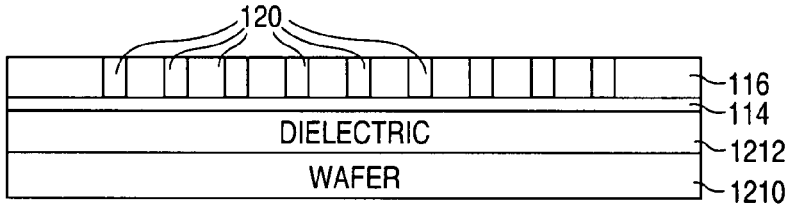
Figure 13C:
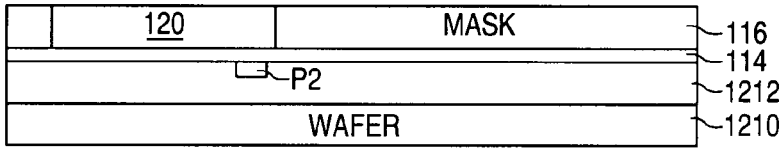
Figure 13D:
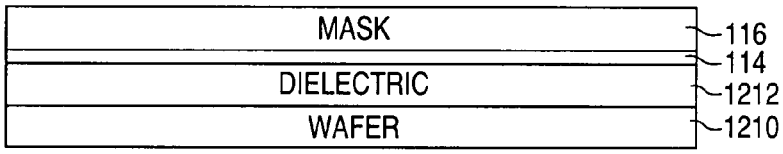
Figure 13E:
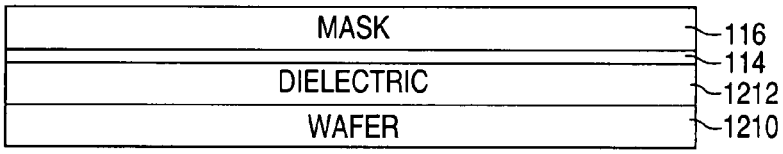
Figure 13F:
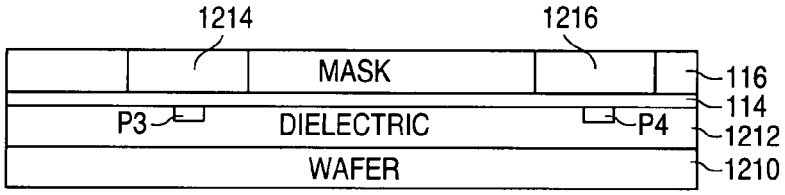
Figure 14A:
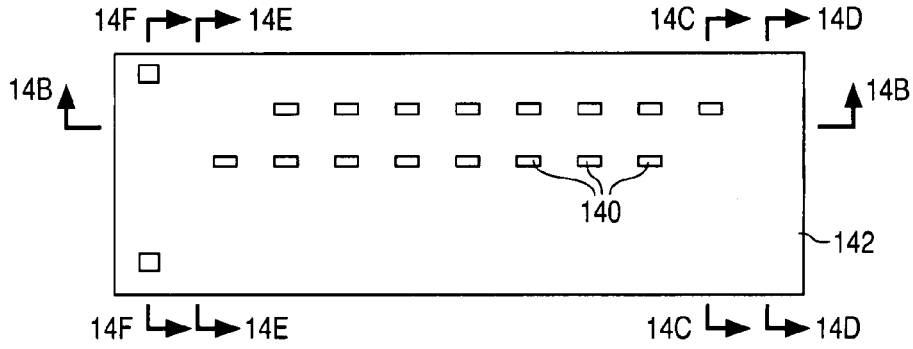
Figure 14B:
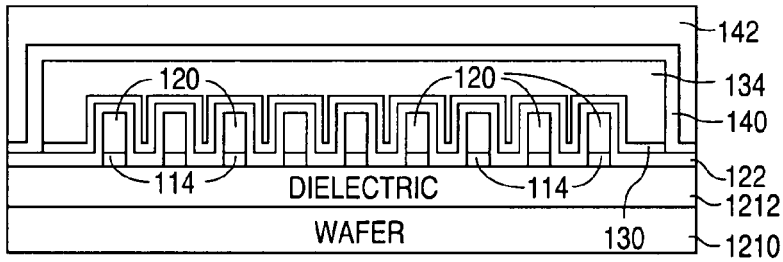
Figure 14C:
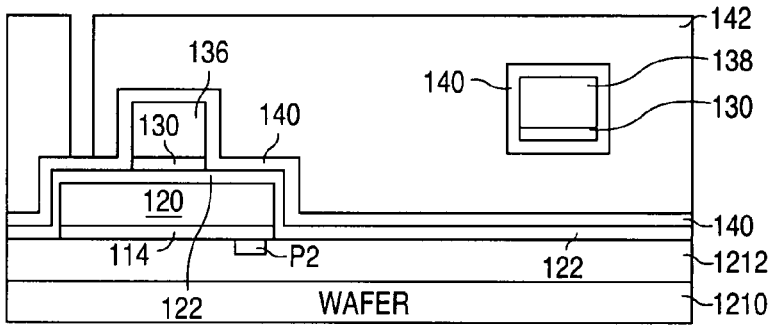
Figure 14D:
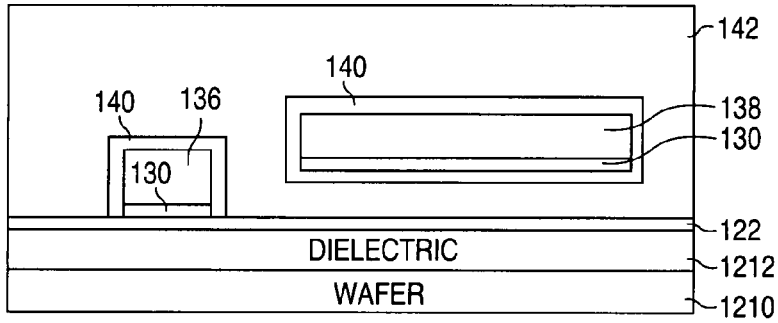
Figure 14E:
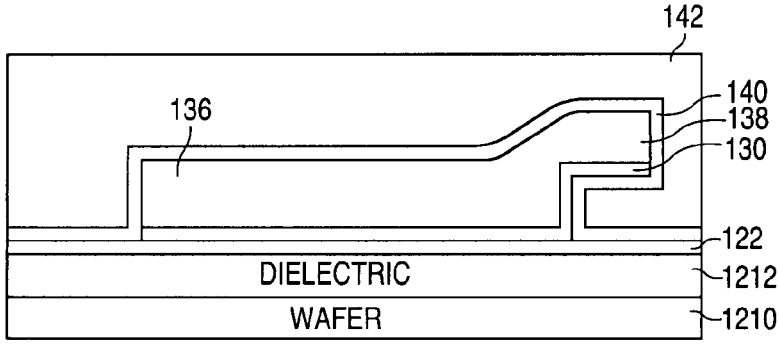
Figure 14F:
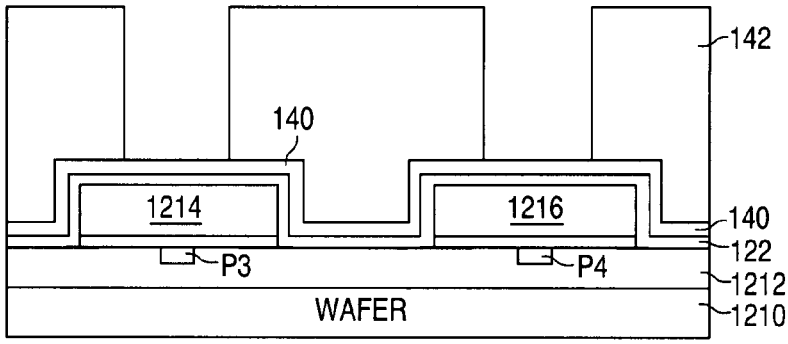
Figure 15A:
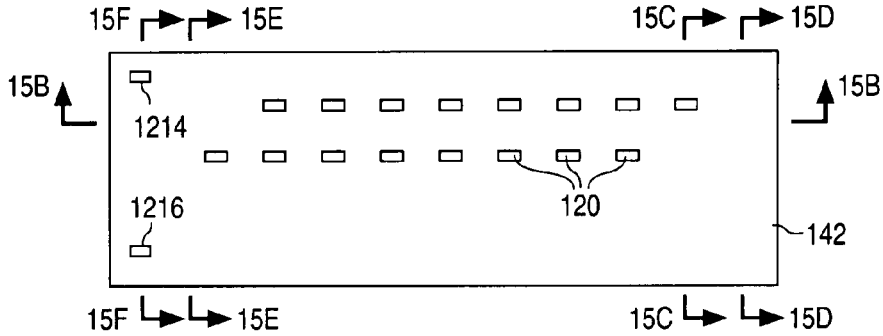
Figure 15B:
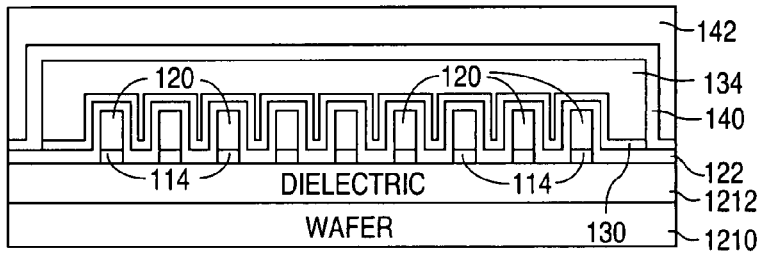
Figure 15C:
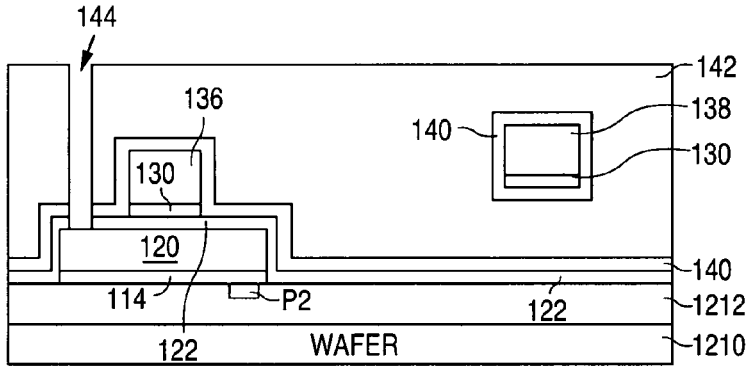
Figure 15D:
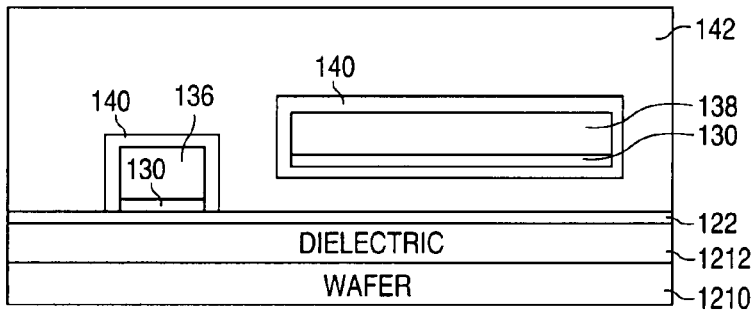
Figure 15E:
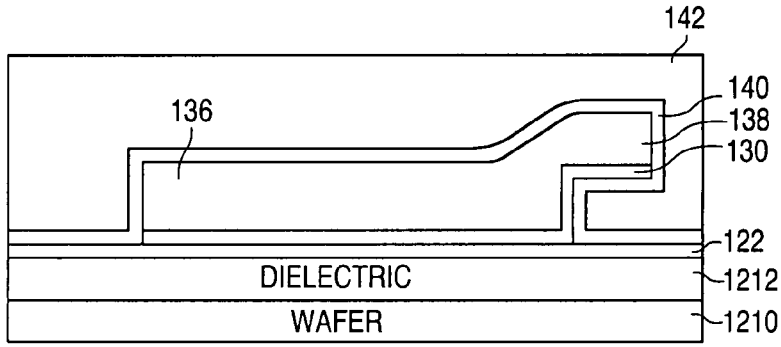
Figure 15F:
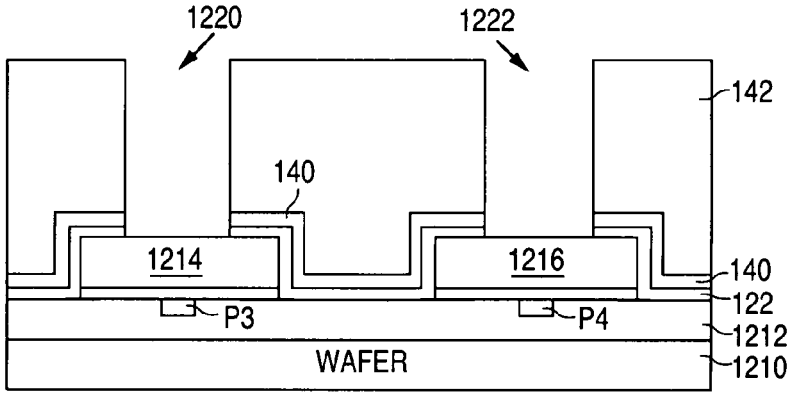
Figure 16A:
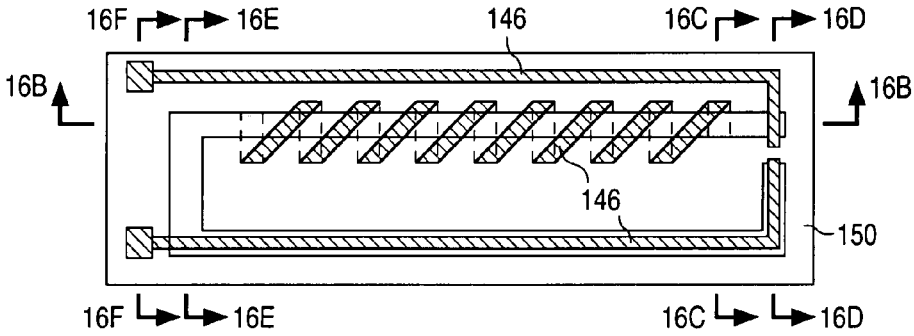
Figure 16B:
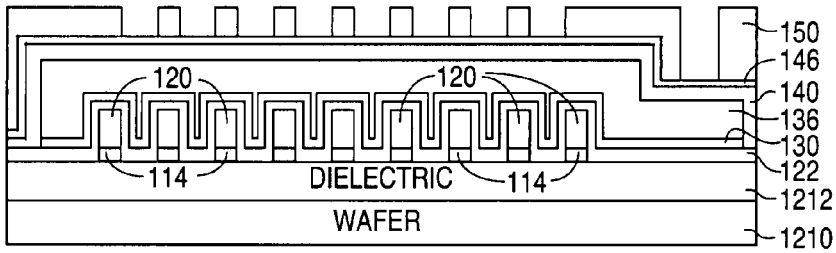
Figure 16C:
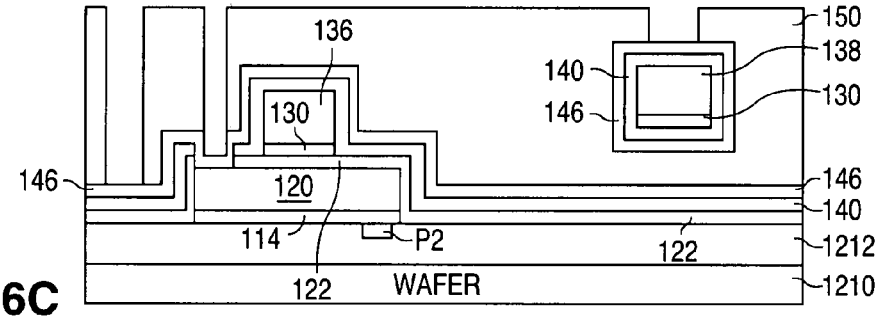
Figure 16D:
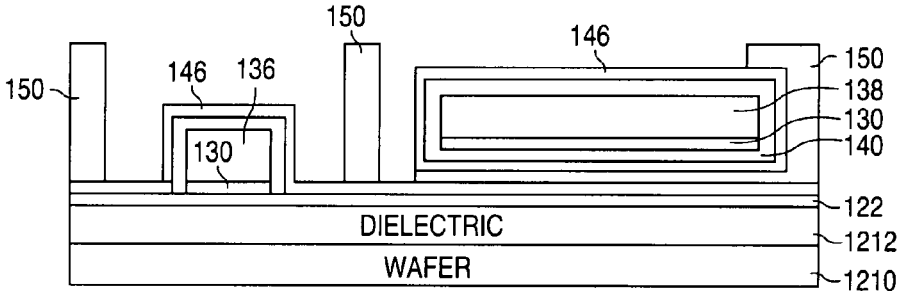
Figure 16E:
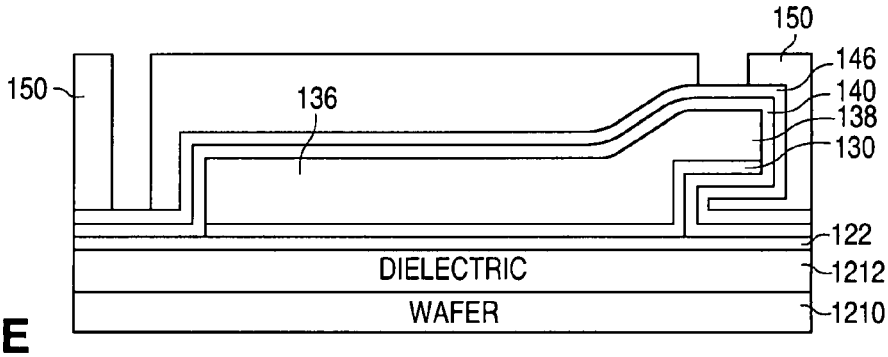
Figure 16F:
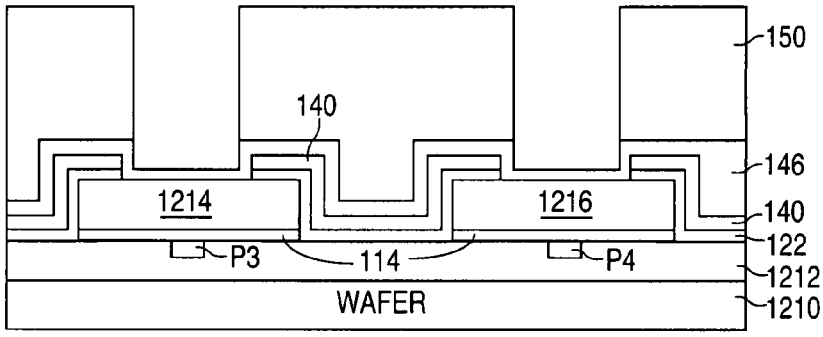
Figure 17A:
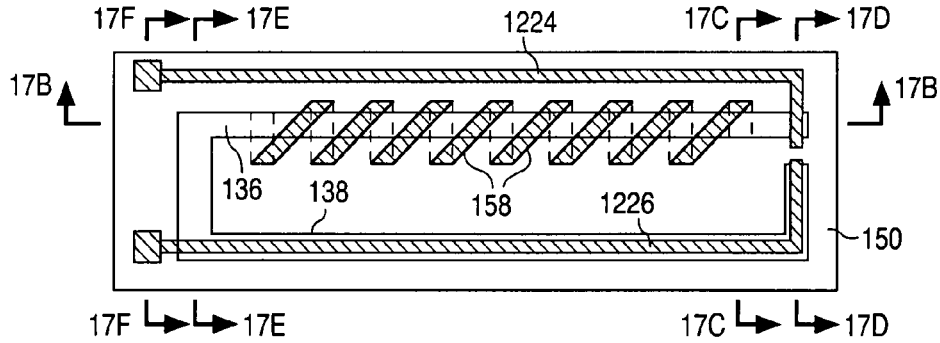
Figure 17B:
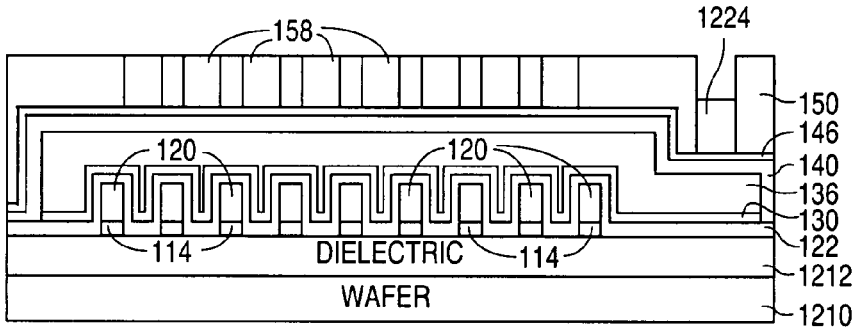
Figure 17C:
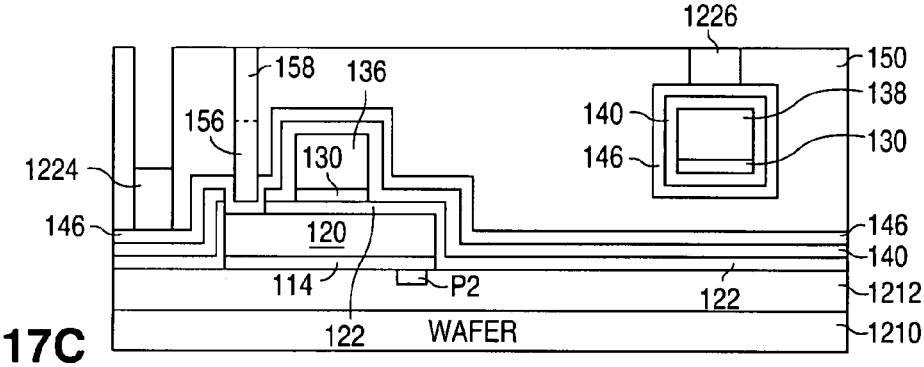
Figure 17D:
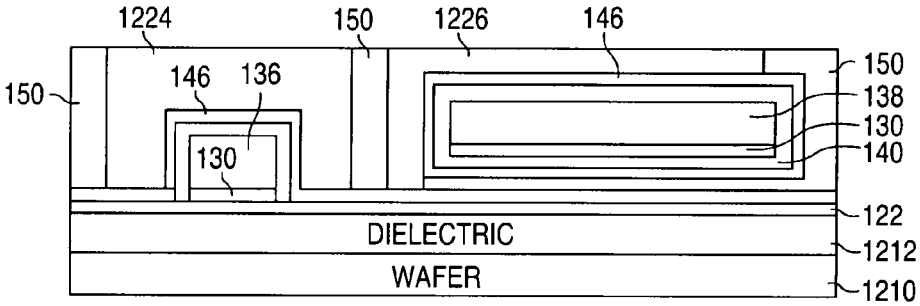
Figure 17E:
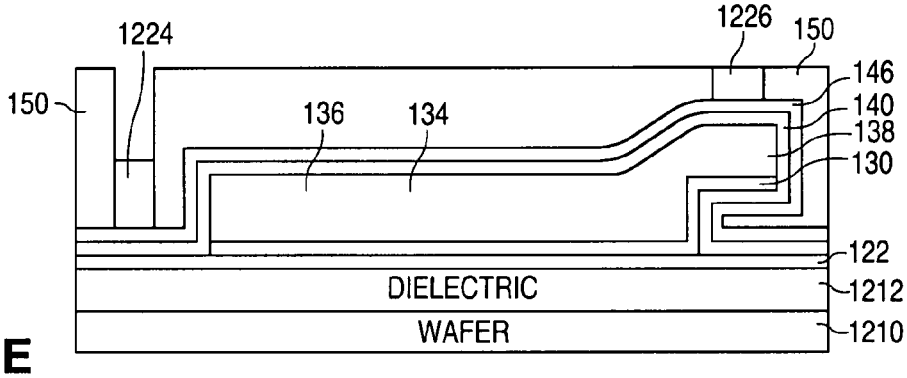
Figure 17F:
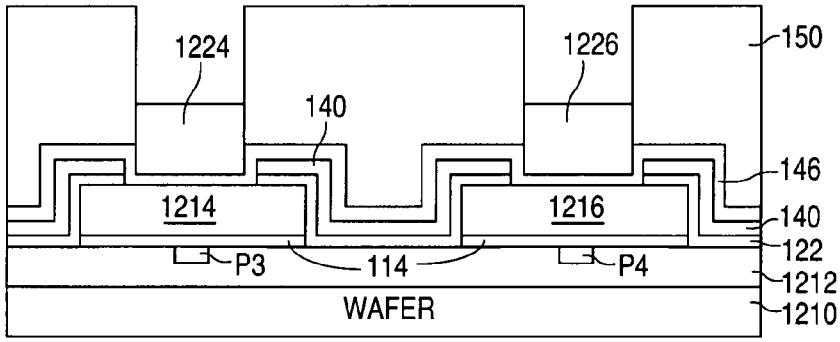
Figure 18A:
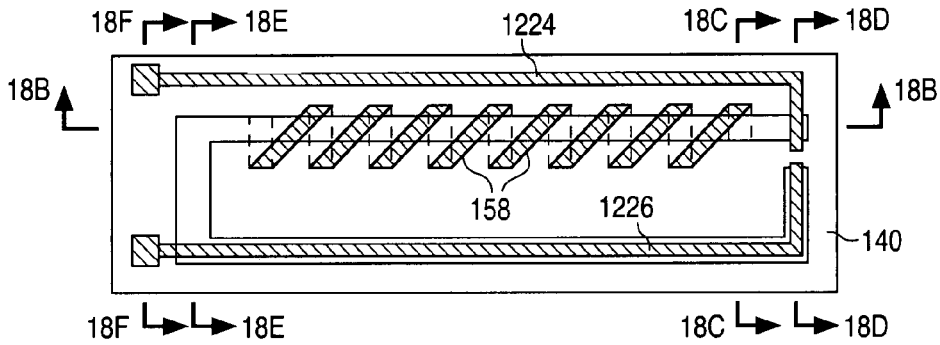
Figure 18B:
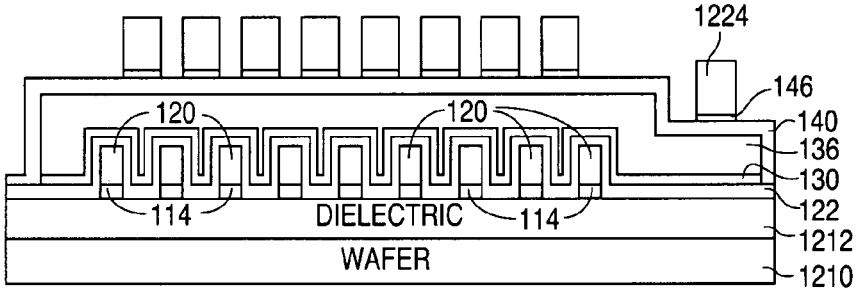
Figure 18C:
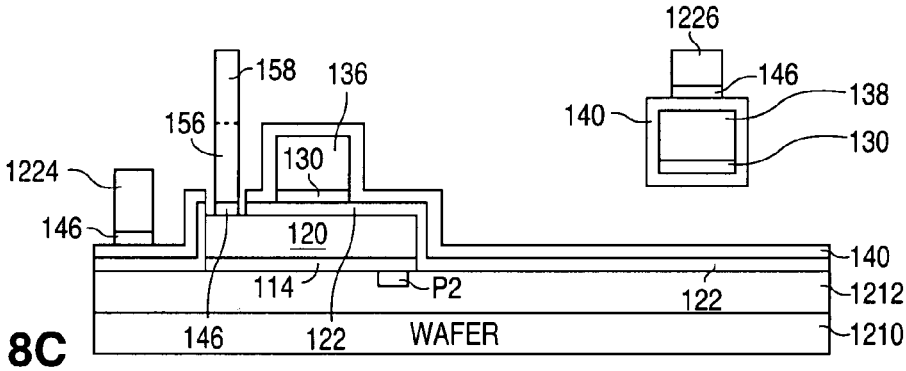
Figure 18D:
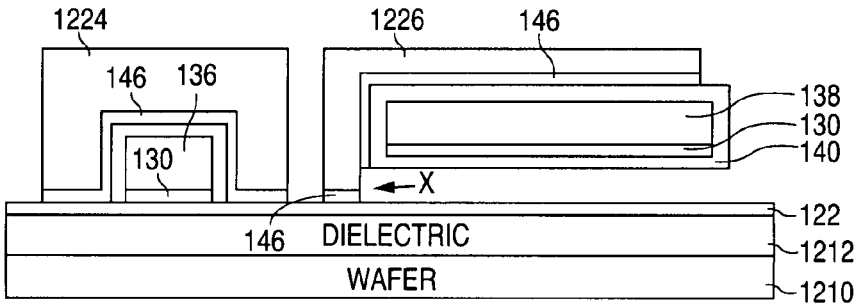
Figure 18E:
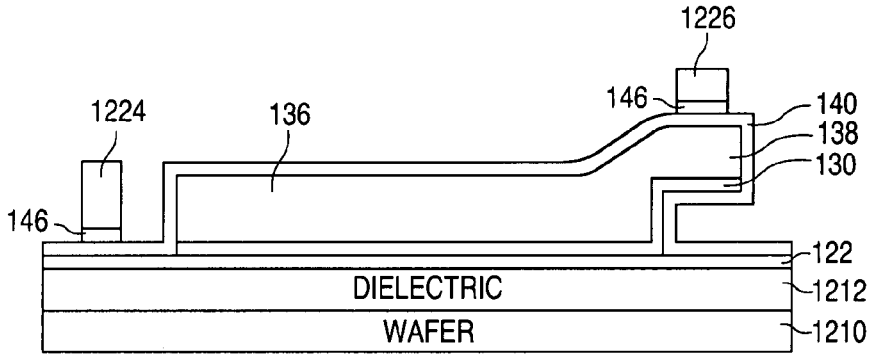
Figure 18F:
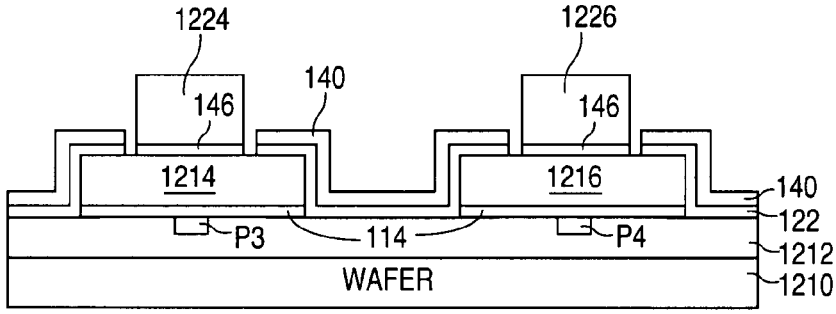
Figure 19A:
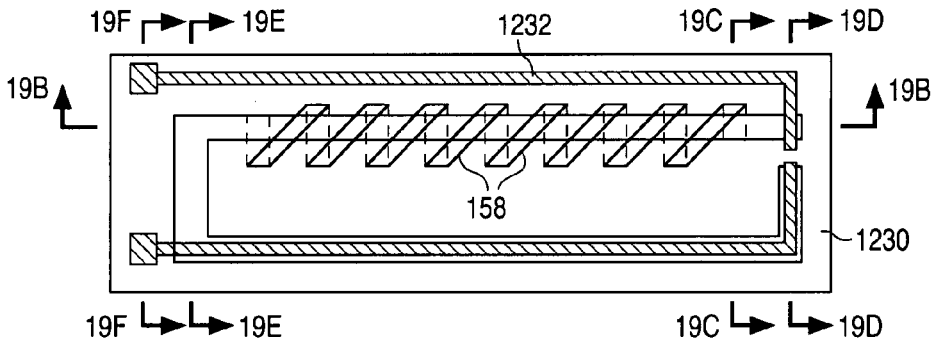
Figure 19B:
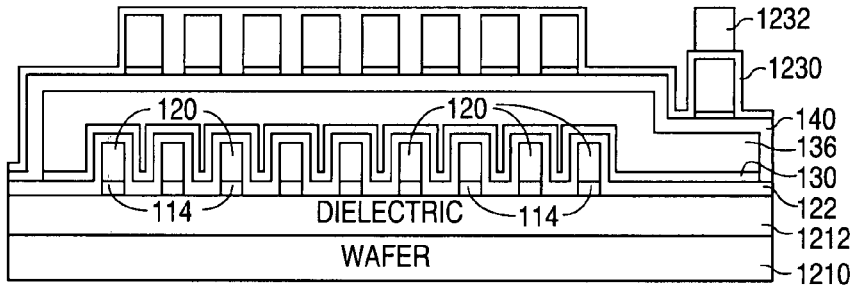
Figure 19C:
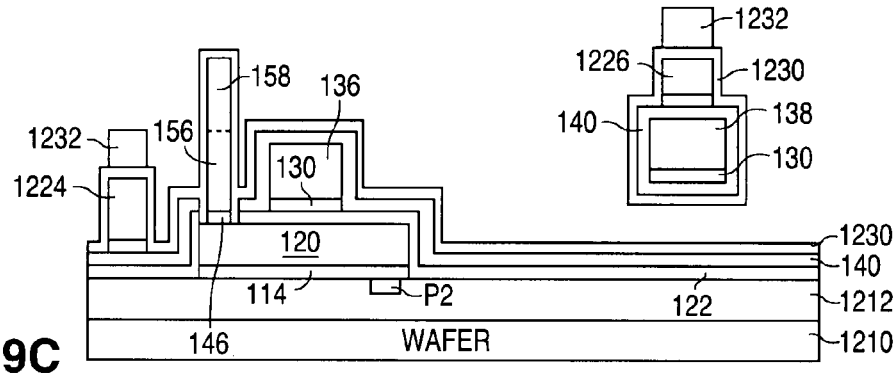
Figure 19D:
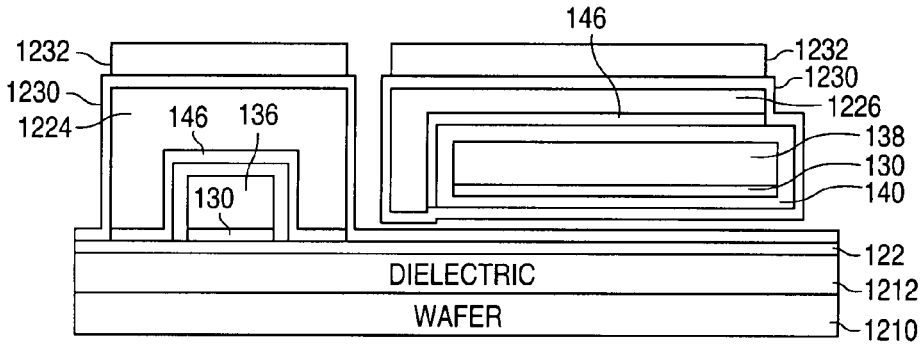
Figure 19E:
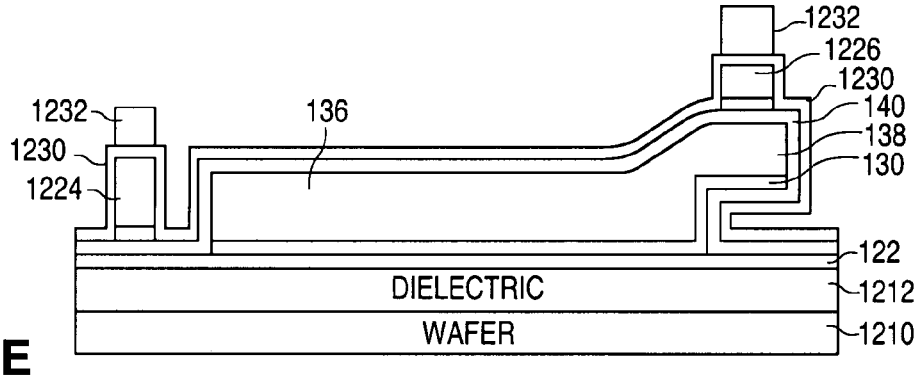
Figure 19F:
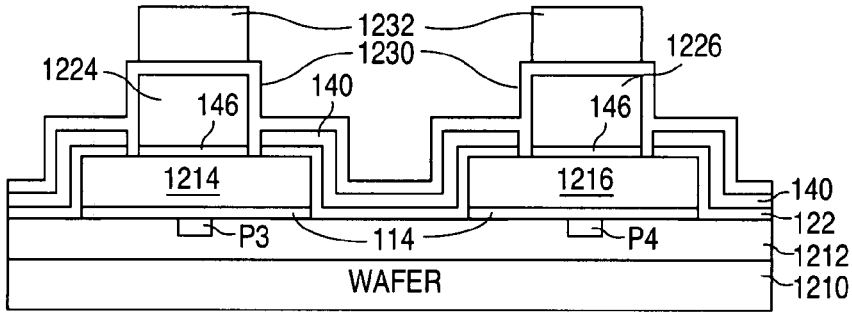

In operation, when no current is present in coil 160, floating cantilever section 138 has the shape shown in FIG. 11A. As shown, the second end 136-E2 of core section 136 and the second end 138-E2 of floating cantilever section 138 are spaced apart by actuation gap 139, thereby providing a first actuation position.

On the other hand, when a current flows through coil 160 and generates an electromagnetic field that is stronger than the spring force of floating cantilever section 138, the electromagnetic field causes the second end 138-E2 of floating cantilever section 138 to move towards the second end 136-E2 of core section 136, thereby providing a second actuation position.

The force required to achieve good movement is in the range of 100 μN. Modeling of actuator 100 gives forces in the range of 100 μN for a coil with five windings, and a core member that is 10 μm wide, 10 μm high, and 500 μm long with a Young's modulus of steel (210 GPa). The modeling of actuator 100 also assumed a gap of 3 μm, and 2.75V of bias passed across the coil (approximately 20 mA of current) whose resistance (the coils) is $3\times10^{-8}\ \Omega m^{-1}$.

FIGS. 12A-20A, 12B-20B, 12C-20C, 12D-20D, 12E-20E, and 12F-20F show a series of views that illustrate a method of forming a MEMS relay 1200 in accordance with the present invention. The method of forming MEMS relay 1200 is similar to the method of forming actuator 100 and, as a result, utilizes the same reference numerals to designate the structures which are common to both methods.

As shown in FIGS. 12A-12F, the method of forming relay 1200 utilizes a conventionally formed single-crystal silicon semiconductor wafer 1210 and an overlying dielectric layer 1212. Like dielectric layer 112, dielectric layer 1212 can represent a dielectric layer that includes no metal structures, or a dielectric layer that includes metal structures, such as the dielectric layer of a metal interconnect structure.

When formed as the dielectric layer of a metal interconnect structure, dielectric layer 1212 includes levels of metal traces, a large number of contacts that connect the bottom metal trace to electrically conductive regions in and on wafer 1210, and a large number of inter-metal vias that connect metal traces in adjacent layers together. Further, selected regions on the top surfaces of the metal traces in the top metal layer function as pads which provide external connection points.

In the present example, dielectric layer 1212 represents the dielectric layer of a metal interconnect structure that also includes pads P1-P4. Pads P1 and P2 are selected regions on the top surfaces of two of the metal traces in the top layer of metal traces that provide electrical connections for a to-be-formed square coil, while pads P3 and P4 are selected regions on the top surfaces of the metal traces that provide electrical connections for a to-be-formed switch. (Only pads P2-P4, and not the entire metal interconnect structure, are shown in cross-section for clarity.)

Referring again to FIGS. 12A-12F, the method of forming relay 1200 begins the same as the method for forming actuator 100, except that seed layer 114 is also formed on pads P3 and P4 in addition to pads P1 and P2. Once seed layer 114 has been formed, mask 116 is formed and patterned as before except that the pattern also exposes the regions of seed layer 114 that lie over pads P3 and P4 in addition the regions of seed layer 114 that lie over pads P1 and P2.

As shown in FIGS. 13A-13F, following the formation and patterning of mask 116, copper is deposited by electroplating as before to form the copper lower sections 120 (the lower sides of the to-be-formed square coil). In addition, copper structures 1214 and 1216 are formed and electrically connected to pads P3 and P4 at the same time that the copper lower sections 120 are formed. After the copper lower sections 120 have been formed, mask 116 is removed, followed by the removal of the underlying regions of seed layer 114.

The method of forming MEMS relay 1200 then follows the same process as described above with respect to FIGS. 3A-3E through 7A-7E up to the formation of mask 142. As shown in FIGS. 14A-14F, mask 142 is formed as above except that the pattern also exposes the regions of dielectric layer 140 that lie over copper structures 1214 and 1216.

Following the formation and patterning of mask 142, as shown in FIGS. 15A-15F, the exposed regions of the dielectric layer 140 and underlying dielectric layer 122 are etched as before to form vertical openings 144. In addition, the etch also forms a vertical opening 1220 that exposes the top surface of copper structure 1214, and a vertical opening 1222 that exposes the top surface of copper structure 1216. Mask 142 is then removed.

Once mask 142 has been removed, as shown in FIGS. 16A-16F, seed layer 146 is formed as before except that seed layer 146 is also formed on the exposed top surfaces of copper structures 1214 and 1216. After seed layer 146 has been formed, mask 150 is formed and patterned as before, except that mask 150 also exposes the regions of seed layer 146 that lie on the top surface of dielectric layer 140 adjacent to core section 136, the top surface of dielectric layer 140 over floating cantilever section 138, and the top surfaces of copper structures 1214 and 1216. The pattern (openings) in mask 150 is shown hatched in FIG. 16A.

Next, as shown in FIGS. 17A-17F, following the formation and patterning of mask 150, copper is deposited by electroplating as before to form the copper side sections 156 and the copper upper sections 158 of the square coil. In addition, a copper first strip 1224 is formed adjacent to and along core section 136, and a copper second strip 1226 is formed over floating cantilever section 138 at the same time that side and upper sections 156 and 158 are formed. Copper first strip 1224 is connected to copper structure 1214, and copper second strip 1226 is connected to copper structure 1216 to provide electrical connectivity for the to-be-formed switch. Copper first strip 1224, copper second strip 1226, and the copper upper sections 158 of the square coil are shown hatched in FIG. 17A.

Following this, as shown in FIGS. 18A-18F, mask 150 and the underlying regions of seed layer 146 are removed. The removal of mask 150 and the underlying regions of seed layer 146 leaves the seed layer 146 (that lies under a portion of second copper strip 1226) connected to dielectric layer 122 as shown by the arrow X in FIG. 18D.

Next, as shown in FIGS. 19A-19F, the seed layer 146 connected to dielectric layer 122 as shown by the arrow X is wet etched for a predetermined period of time to thereby free floating cantilever structure 138 from any connection with underlying dielectric layer 122. Once free, the end wall face of second copper second strip 1226 can contact the end wall face of first copper strip 1224 when end 138-E2 of floating cantilever section 138 moves a distance horizontally towards end 138-E1 of core section 136.

Following this, a conductive layer 1230, such as a layer of titanium, nickel, or chrome, and an overlying layer of gold, is deposited on dielectric layer 140, the copper upper sections 158, and the first and second strips 1224 and 1226. Conductive layer 1230 is electrically isolated from core section 136 and floating cantilever section 138 by regions of dielectric layer 140.

When sputtered, titanium, nickel, chrome, and gold provide good coverage on the high-aspect ratio (vertical) end walls of the core and floating cantilever sections 136 and 138 that face each other. Titanium, nickel, and chrome, in turn, improve the adhesion of gold. After conductive layer 1230 has been formed, a mask 1232 is formed and patterned on conductive layer 1230. The regions of conductive layer 1230 that are protected by mask 1232 are shown hatched in FIG. 19A.

As shown in FIGS. 20A-20F, following the formation and patterning of mask 1232, the exposed regions of conductive layer 1230 are etched away to form a first end plate 1234 that lies adjacent to the second end 136-E2 of core section 136, and a trace 1236 that electrically connects first end plate 1234 to conductive structure 1214. The etch also forms a second end plate 1240 that lies adjacent to the second end 138-E2 of floating cantilever section 138, and a trace 1242 that electrically connects second end plate 1240 to conductive structure 1216.

Figure 20A:
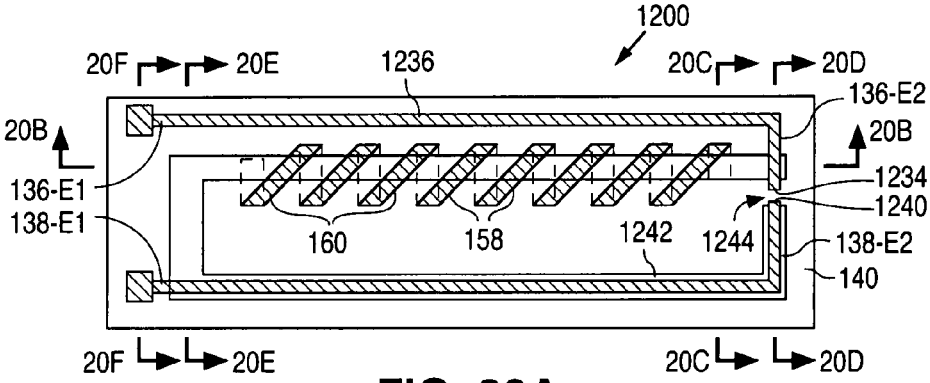
Figure 20B:
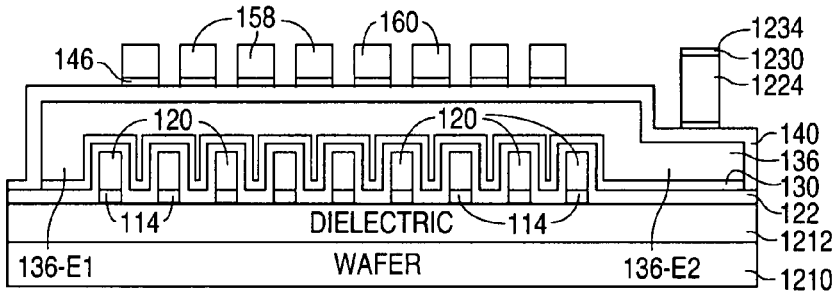
Figure 20C:
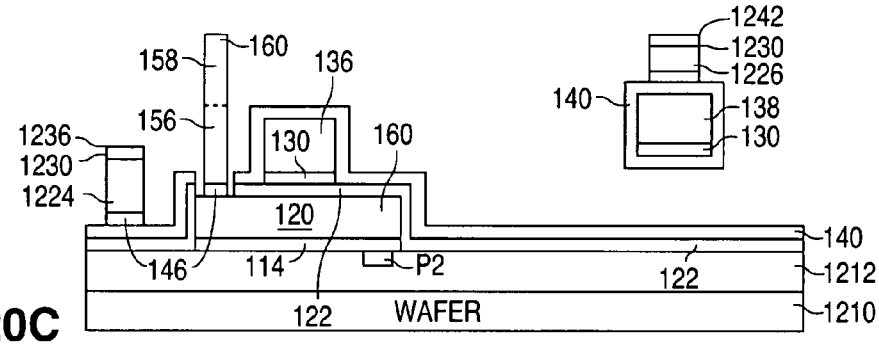
Figure 20D:
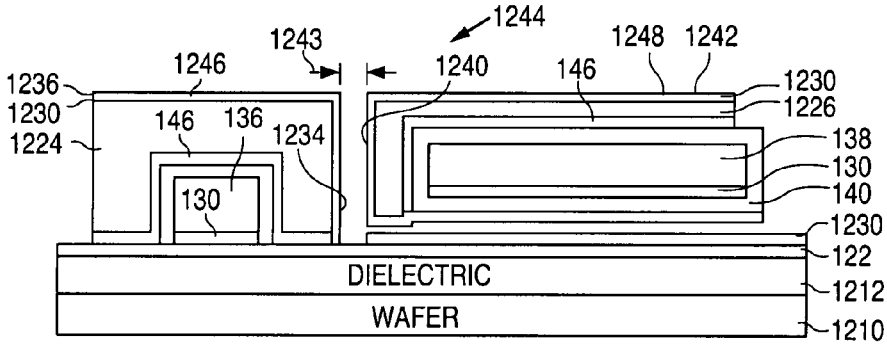
Figure 20E:
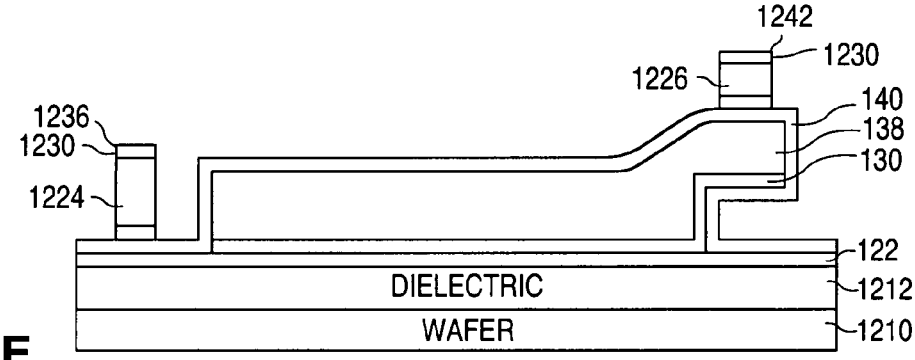
Figure 20F:
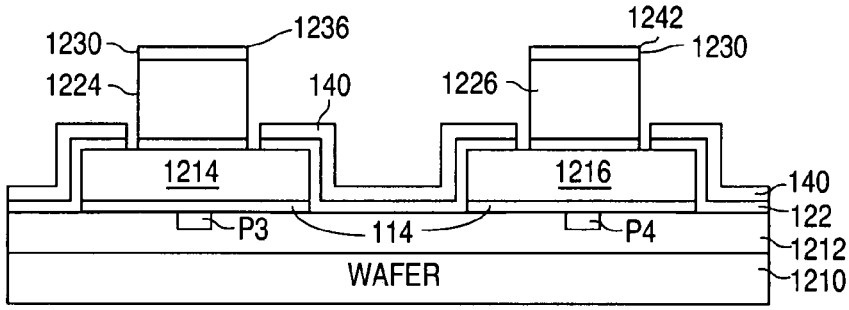

In addition, as further shown in FIG. 20D, first end plate 1234 and second end plate 1240 are horizontally spaced apart by a switch gap 1243. The size of switch gap 1243 is defined by the patterns in mask 150 and the thickness of conductive layer 1230. Mask 1232 is then removed to complete the process.

Thus, a method of forming relay 1200 has been described. As shown in FIGS. 20A-20F, relay 1200 is the same as actuator 100 except that relay 1200 includes a switch 1244 that has a first electrode 1246 and a second electrode 1248. First electrode 1246 is implemented with first end plate 1234, trace 1236, and first copper strip 1224. Second electrode 1248, which rides on floating cantilever section 138, is implemented with second end plate 1240, trace 1242, and second copper strip 1226.

In operation, when no current is present, floating cantilever section 138 has the shape shown in FIG. 20A. As shown, first electrode 1246 and second electrode 1248 are spaced apart by switch gap 1243, thereby providing a high-impedance electrical pathway. On the other hand, when a current flows through coil 160 and generates an electromagnetic field that is stronger than the spring force of floating cantilever section 138, the floating end 138-E2 of floating cantilever section 138 bends towards the second end 136-E2 of core section 136 so that the first end plate 1234 of first electrode 1246 touches the second end plate 1240 of second electrode 1248, thereby providing a low-impedance electrical pathway.

As noted above, dielectric layers 112 and 1212 can represent a dielectric layer that is free of metal structures. When free of metal structures, the electrical connections to coil 160 can be made, for example, by wire bonding to points on the copper upper sections 158 that represent opposite ends of coil 160. In addition, connections to the first and second electrodes 1246 and 1248 can be made, for example, by wire bonding to traces 1236 and 1242.

One of the advantages of the present invention is that the present invention requires relatively low processing temperatures. As a result, the present invention is compatible with conventional backend CMOS processes.

It should be understood that the above descriptions are examples of the present invention, and that various alternatives of the invention described herein may be employed in practicing the invention. For example, the various seed layers can be implemented as copper seed layers, or as tungsten, chrome, or combination seed layers as need to provide the correct ohmic and mechanical (peel) characteristics. Thus, it is intended that the following claims define the scope of the invention and that structures and methods within the scope of these claims and their equivalents be covered thereby.

What is claimed is:

1. A method of forming a MEMS device on a first non-conductive layer that lies over a semiconductor material, the method comprising:

forming a plurality of lower coil sections that touch the first non-conductive layer, the plurality of lower coil sections being conductive and spaced apart;

forming a second non-conductive layer that touches the plurality of lower coil sections; and forming an actuation member that touches the second non-conductive layer, the actuation member including a core section that lies directly over the plurality of lower coil sections, and a cantilever section that lies horizontally adjacent to the core section, the cantilever section being vertically spaced apart from the second non-conductive layer, the core section and the cantilever section being conductive and electrically isolated from each of the plurality of lower coil sections, the core section having an end, the cantilever section having an end, the end of the cantilever section being horizontally movable towards the end of the core section.

2. The method of claim 1 and further comprising:

forming a third non-conductive layer that touches the core section; and forming a plurality of upper coil sections that touch the third non-conductive layer and lie over the core section.

3. The method of claim 2 and further comprising forming a plurality of side coil sections that touch the plurality of lower coil sections when the plurality of upper coil sections are formed, the plurality of lower coil sections, the plurality of side coil sections, and the plurality of upper coil sections being electrically connected together to form a coil.

4. The method of claim 3 wherein the core section extends through the coil.

5. The method of claim 4 wherein the cantilever section lies outside of the coil.

6. The method of claim 2 wherein a top surface of the core section lies below a top surface of the cantilever section.

7. The method of claim 2 wherein each lower coil section of the plurality of lower coil sections includes a seed layer and an overlying metallic layer.

8. The method of claim 2 wherein the core section and the cantilever section are a single unitary structure having an indivisible character.

9. The method of claim 2 wherein the actuation member includes a seed layer and an overlying metallic layer.

10. The method of claim 2 wherein the actuation member includes a magnetic material.

11. The method of claim 10 wherein the magnetic material is an alloy of nickel and iron.

12. The method of claim 2 and further comprising:

forming a first conductive strip on the third non-conductive layer; and forming a second conductive strip on the third non-conductive layer.

13. The method of claim 12 wherein the first conductive strip includes a seed layer and an overlying metallic layer.

14. The method of claim 12 wherein a portion of the first conductive strip lies directly over the end of the core section.

15. The method of claim 14 wherein a portion of the second conductive strip lies directly over the end of the cantilever section.

16. The method of claim 15 wherein the plurality of side coil sections, the plurality of upper coil sections, the first conductive strip, and the second conductive strip are formed simultaneously.

17. The method of claim 15 wherein an end wall of the first conductive strip contacts an end wall of the second conductive strip when the cantilever section moves a distance horizontally towards the end of the core section.

18. The method of claim 17 and further comprising:

forming a first conductive line that touches the first conductive region, including the end wall of the first conductive region; and forming a second conductive line that touches the second conductive region, including the end wall of the second conductive region.

19. The method of claim 18 wherein the first and second conductive lines include gold.

20. A method of forming a MEMS device on a first non-conductive layer that lies over a semiconductor material, the method comprising:

forming a plurality of lower coil sections that touch the first non-conductive layer, the plurality of lower coil sections being conductive and spaced apart, each lower coil section having a first end and a second end;

forming a second non-conductive layer that touches the plurality of lower coil sections; and forming an actuation member that touches the second non-conductive layer, the actuation member being conductive and electrically isolated from each of the plurality of lower coil sections, and having a first end, a second end that is laterally separated from the first end by an actuation gap when no current flows through the plurality of lower coil sections, and a body that extends continuously from the first end to the second end, only a portion of the body lying directly over the plurality of lower coil sections;

forming a plurality of upper coil sections that are electrically isolated from the actuation member, each upper coil section being spaced apart and having a first end that touches the first end of a lower coil section, and a second end that touches the second end of an adjacent lower coil section to form a coil loop that surrounds the actuation member.

21. The method of claim 20 wherein the actuation member includes a magnetic material.

22. The method of claim 21 wherein the magnetic material is an alloy of nickel and iron.

23. The method of claim 20 and further comprising:

forming a third non-conductive layer that touches the actuation member; and forming first and second spaced-apart conductive strips that touch the third non-conductive layer, the first spaced-apart conductive strip extending out to the first end of the actuation member, the second spaced-apart conductive strip extending out to the second end of the actuation member.

24. The method of claim 20 wherein:

each lower coil section of the plurality of lower coil sections includes a seed layer and an overlying metallic layer;

each upper coil section of the plurality of upper coil sections includes a seed layer and an overlying metallic layer; and the actuation member includes a seed layer and an overlying metallic layer.

* * * * *